US006115973A

United States Patent [19]

Goto

[11] Patent Number: 6,115,973

[45] Date of Patent: Sep. 12, 2000

[54] JOINT DEVICE FOR FLOOR

[75] Inventor: Hideo Goto, Kuwana, Japan

[73] Assignee: Doei Gaiso Yugen Gaisha, Mie-ken, Japan

[21] Appl. No.: 09/128,502

[22] Filed: Aug. 3, 1998

[30] Foreign Application Priority Data

Nov. 26, 1997 [JP] Japan ..... 9-340577

[51] Int. Cl.[7] ..... E04B 1/98; E04H 9/02

[52] U.S. Cl. ..... 52/167.4; 52/396.04

[58] Field of Search ..... 52/167.4, 396.04

[56] References Cited

U.S. PATENT DOCUMENTS 5,887,308 3/1999 Walter ..... 52/396.04

FOREIGN PATENT DOCUMENTS 551974 3/1993 Japan ..... 52/167.4

*Primary Examiner*—Christopher T. Kent
*Assistant Examiner*—Dennis L. Dorsey
*Attorney, Agent, or Firm*—Jordan and Hamburg LLP

[57] ABSTRACT

A joint device of present invention provides a covering apparatus for a floor joint whereat building portions are joined and includes an end joint plate which is biased to project outwardly by a bias device allowing movement following oscillation movements of the building portion such that gaps at end portions of the joint do not open even when the building portions are oscillated due to an earthquake.

25 Claims, 39 Drawing Sheets

JOINT DEVICE FOR FLOOR

BACKGROUND OF THE INVENTION

The present invention relates generally to a joint device, especially for a floor surface covering and for concealing a joint between right and left building portions defining the joint.

The conventional joint device, especially for a floor surface, includes a substrate rail which is fixed in a recessed portion formed at a portion adjacent a joint of right and left building portions; a joint plate supported at the portion of the joint side of the substrate rail on both sides thereof; and a cover plate attached to each of the substrate rails so as to cover upper parts of both sides of the joint plate.

In the conventional joint device for a floor, when right and left building portions are laterally oscillated due to earthquake or the like, the joint plate and support part of the substrate rails are slidably disposed and can absorb the oscillation movement. On the other hand, when right and left building portions are oscillated in a back-and-forth relative direction, the joint cover moves against each wall of the building portions and the plate is damaged. Thus, the joint between the building portions and joint device members have to be arranged a predetermined space apart which is unsightly.

SUMMARY OF THE INVENTION

The present invention provides a joint cover for covering a joint gap in a floor between first and second building portions wherein the joint gap is bounded by side wall pairs. Support members are disposed across the joint gap leaving an end opening between an end one of the support members and one of the side wall pairs. The support members are supported on rollers. An end support member has a width smaller than that of the end opening and is disposed across the joint gap in the end opening. An end joint plate forms an upper surface of the end support member and the end support member has a rectangular form except with four tapered off corners. A biasing device for biases the end support member toward the one of the side wall pairs such that the end joint plate abuts the one of the side wall pairs and the biasing device is attached pivotably at a central portion adjacent an outer edge of the end joint plate. A joint plate covers the support members and has an end portion projecting so as to cover a portion of the end joint plate.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only, and are not intended as a definition of the limits of the invention.

DETAILED DESCRIPTION

Preferred embodiments of the present invention are described in detail below, referring to the accompanying drawings.

An understanding of the present invention may be best gained by reference to FIGS. 1 to 15. FIGS. 1 to 15 illustrate a joint device 1 for a floor of a first embodiment of the present invention. The joint device 1 is provided in recessed portions 4,4 which are formed in floor surfaces adjacent sides of a joint 2 between right and left building portions 3,3 defining the joint 2.

Figure 1:
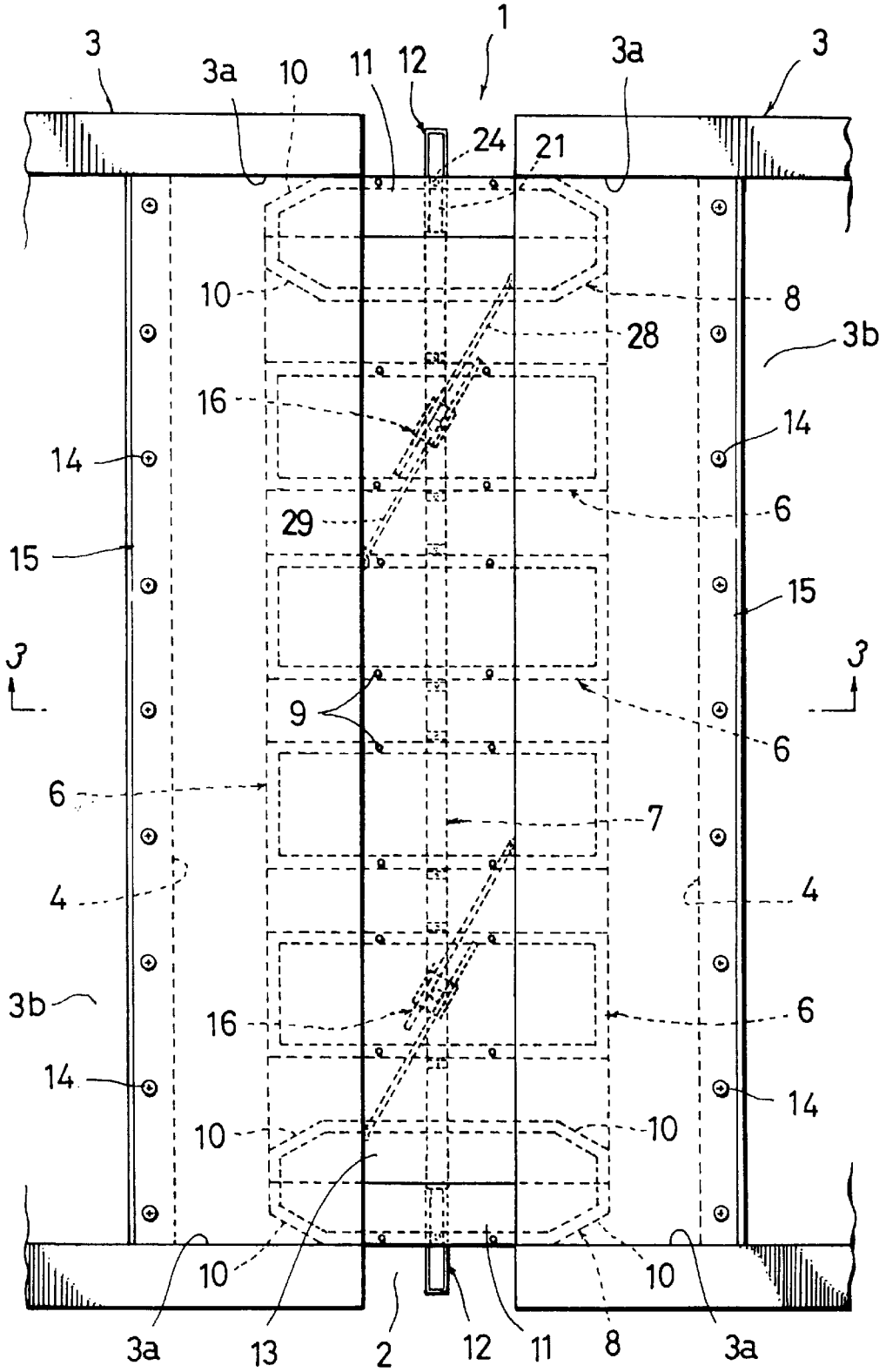
FIG. 1 is a plan view showing a first embodiment of the present invention.
Figure 2:
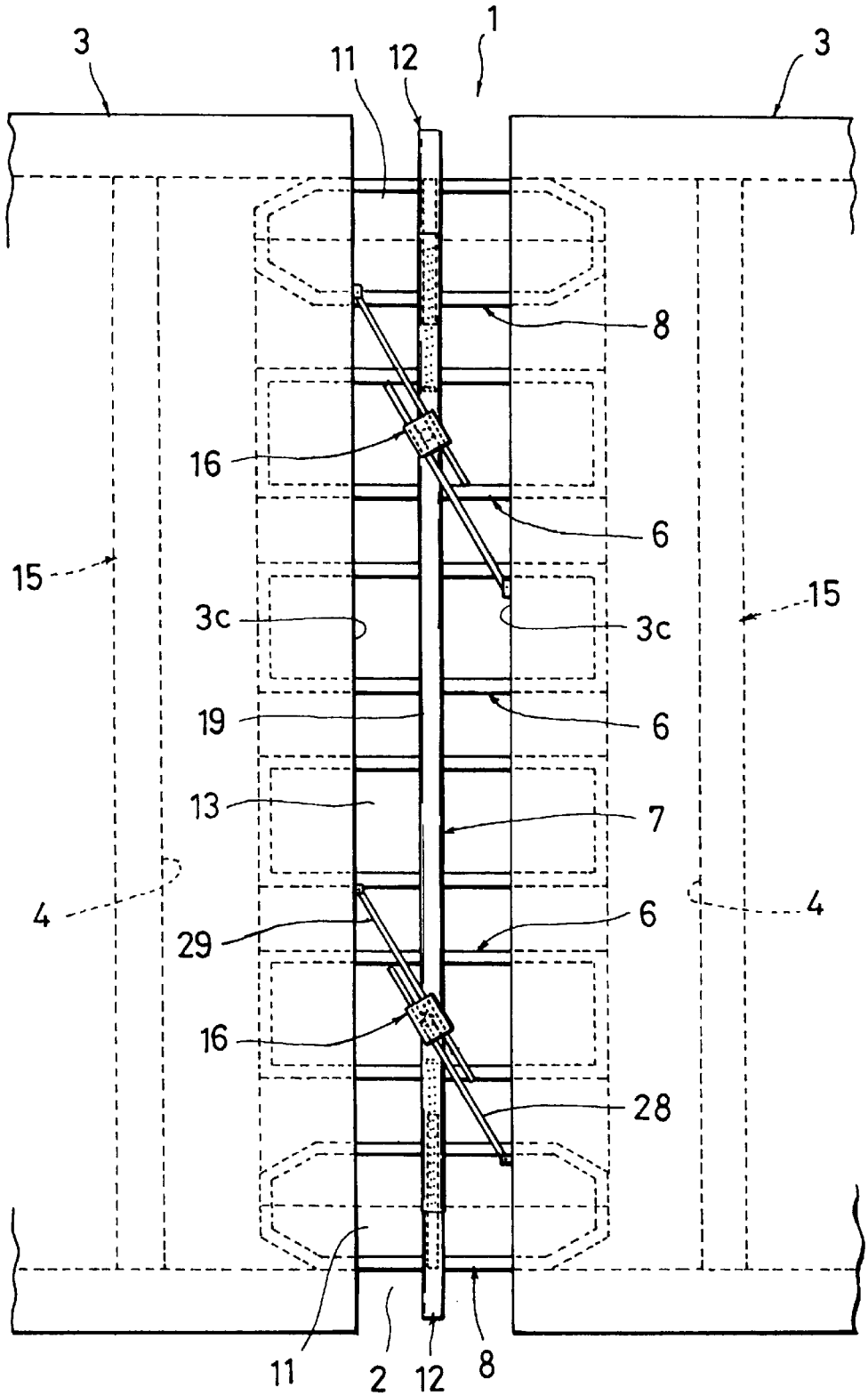
FIG. 2 is a bottom view showing the first embodiment of the present invention.
Figure 3:
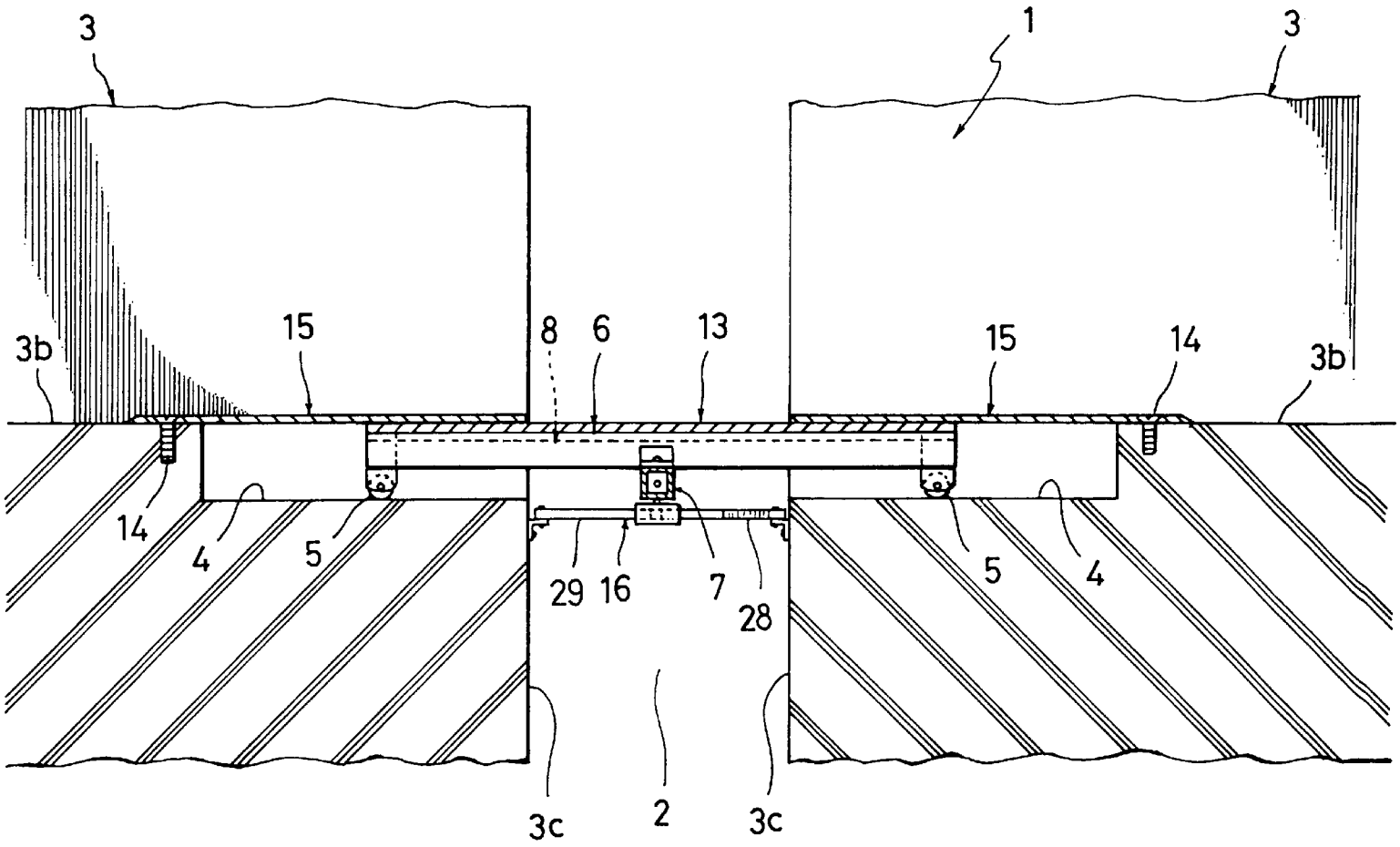
FIG. 3 is a cross-sectional view taken along the line 3—3 of FIG. 1.
Figure 4:
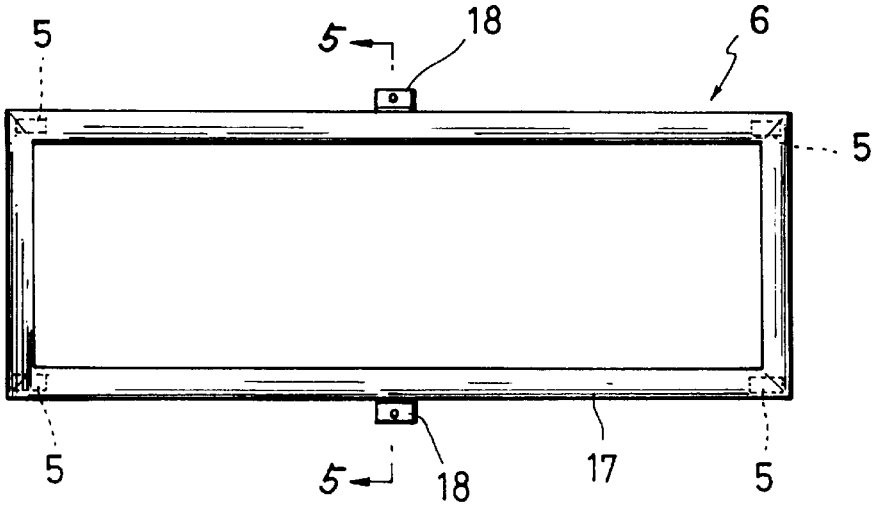
FIG. 4 is a plan view of a support member of the first embodiment of the present invention.
Figure 5:
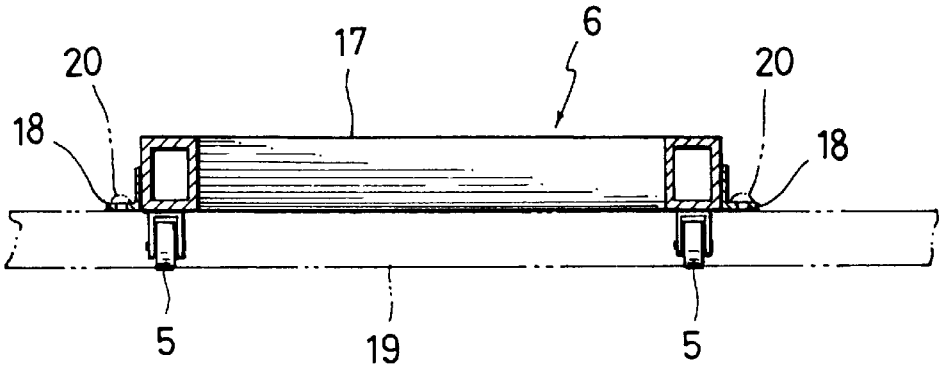
FIG. 5 is a cross-sectional view taken along the line 5—5 of FIG. 4

The joint device 1 includes a plurality of support members 6 and end support members 8 which are disposed in the recessed portions 4,4 so as to move in a right-left direction of FIGS. 1–3 and cross the joint 2 without leaving open portions at end parts of the joint 2 of the floor surface. The support members 6 are disposed so as to and leave an opening between the support members 6, 6 at ends and wall surfaces 3*a* and, as shown in FIGS. 4 and 5, include a frame having rollers 5,5,5,5, such as casters or roller bearings, at corners on a bottom surface thereof. A connecting device 7 connects the plurality of support members 6 in series.

Figure 6:
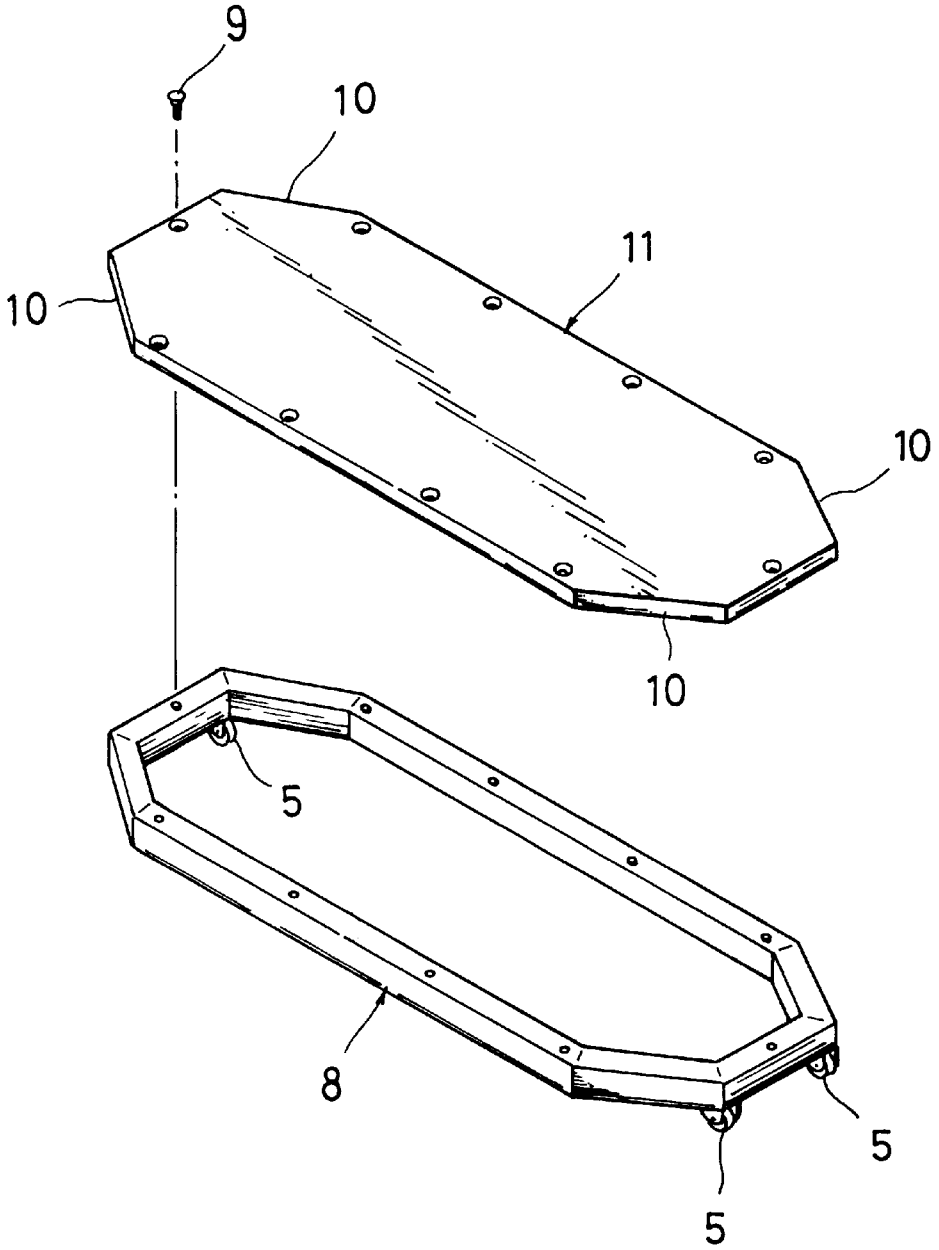
FIG. 6 is an exploded view of an end joint plate assembly of the first embodiment of the present invention.

End support members 8,8, as shown in FIGS. 1, 2 and 6, are disposed in the recessed portions 4,4 in the openings between the support members 6 and the wall suraces 3*a* at both ends of the joint 2 so as to move within the recessed portions 4, 4 in the right-left direction across the joint 2 without contacting end surfaces of the recessed portions 4. The end support members 8, 8 include a frame a having rollers 5,5,5,5, such as casters or ball bearings, provided at corners on a bottom surface thereof. The end support members 8, 8 have a width smaller than that of of a distance of the openings between the support members 6 and wall surfaces 3*a* of the building portions 3. Further provided are end joint plates 11,11, as shown in FIG. 6, attached by a plurality of flat head screws 9, or the like, so as to provide an upper surface of the end support members 8,8. Sloping surfaces 10,10,10,10 provide tapered corners.

Figure 10:
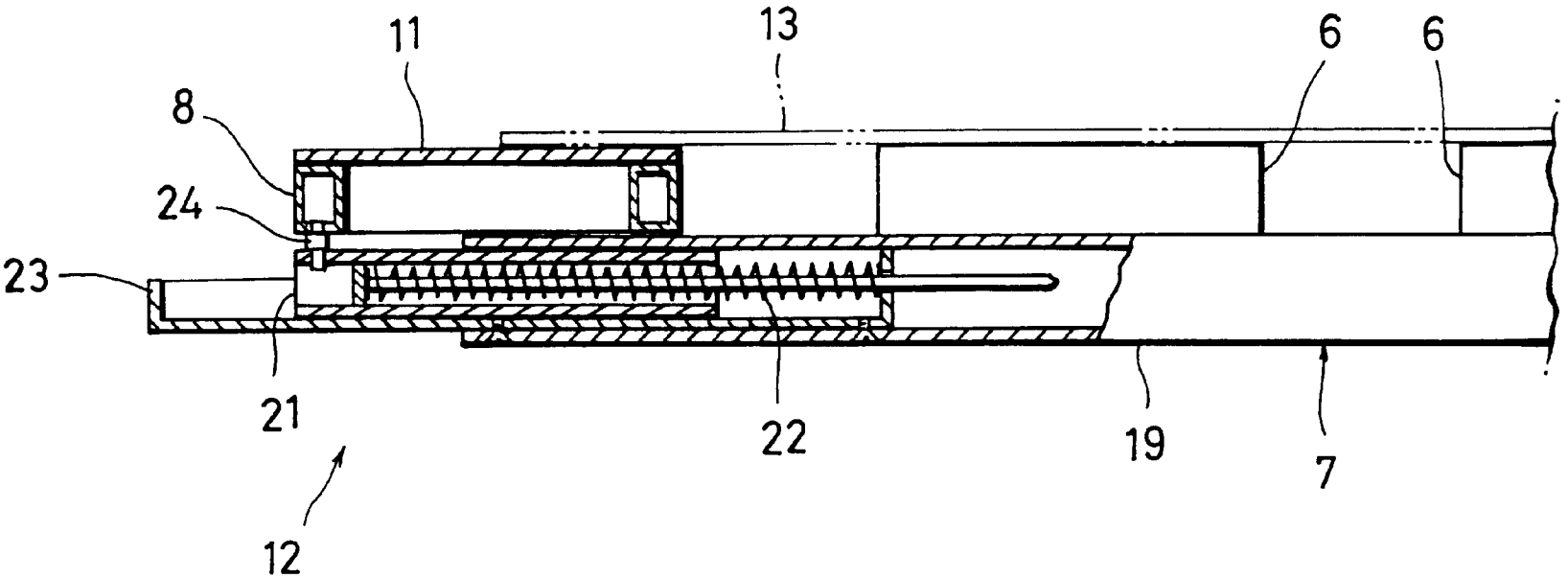
FIG. 10 is a partial cross-sectional view of a device for energizing an end support member of the first embodiment of the present invention.

Referring to FIGS. 1, 2 and 10, bias devices 12 bias the end support members 8, 8 which are mounted pivotably at a central portion of the bias devices 12 and adjacent outer edges of the end joint plates 11,11. The bias devices 12 bias the end support members 8, 8 to abut edges of the end joint plate against wall surfaces 3*a*, 3*a* of the right and left building portions 3, 3.

Figure 7:
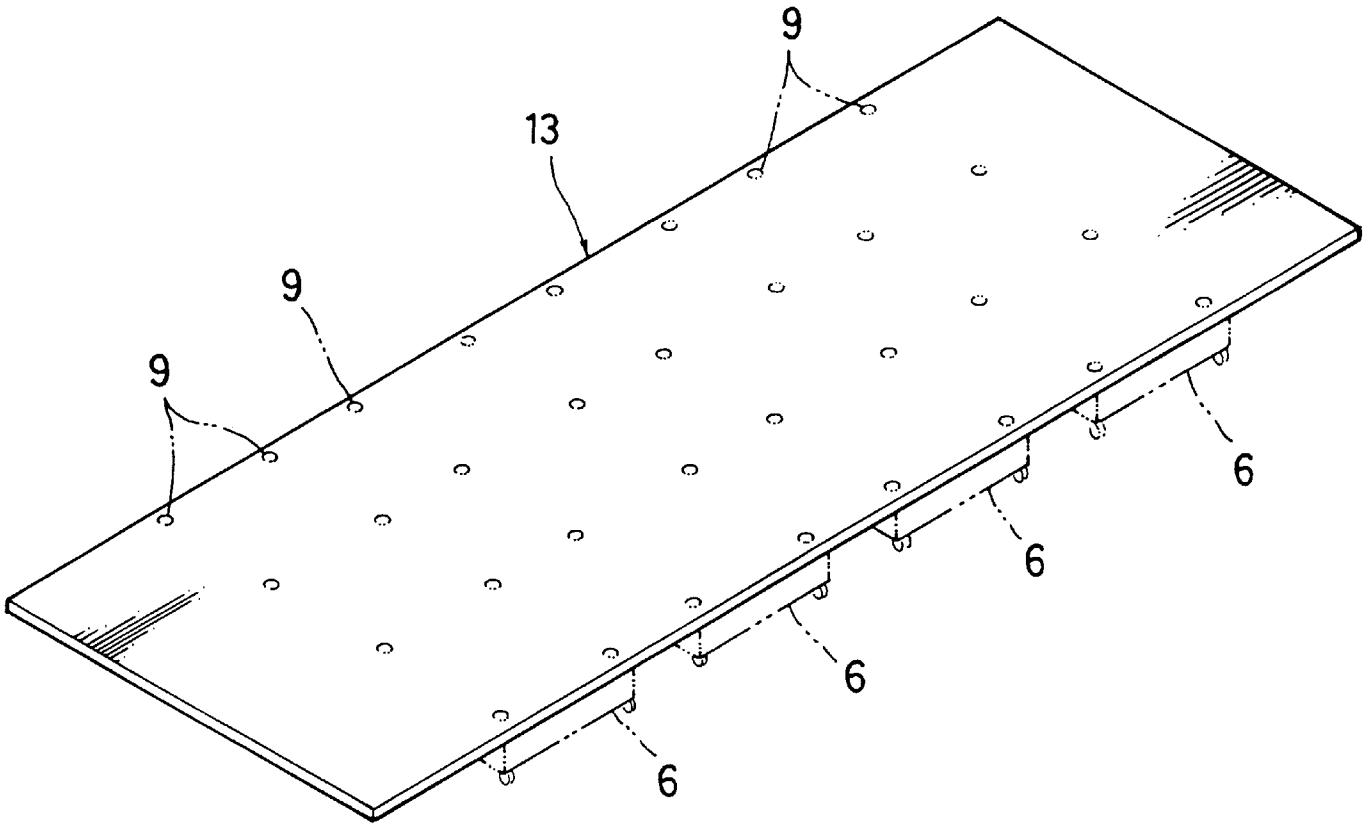
FIG. 7 is a perspective view of a joint plate according to the first embodiment of the present invention.
Figure 8:
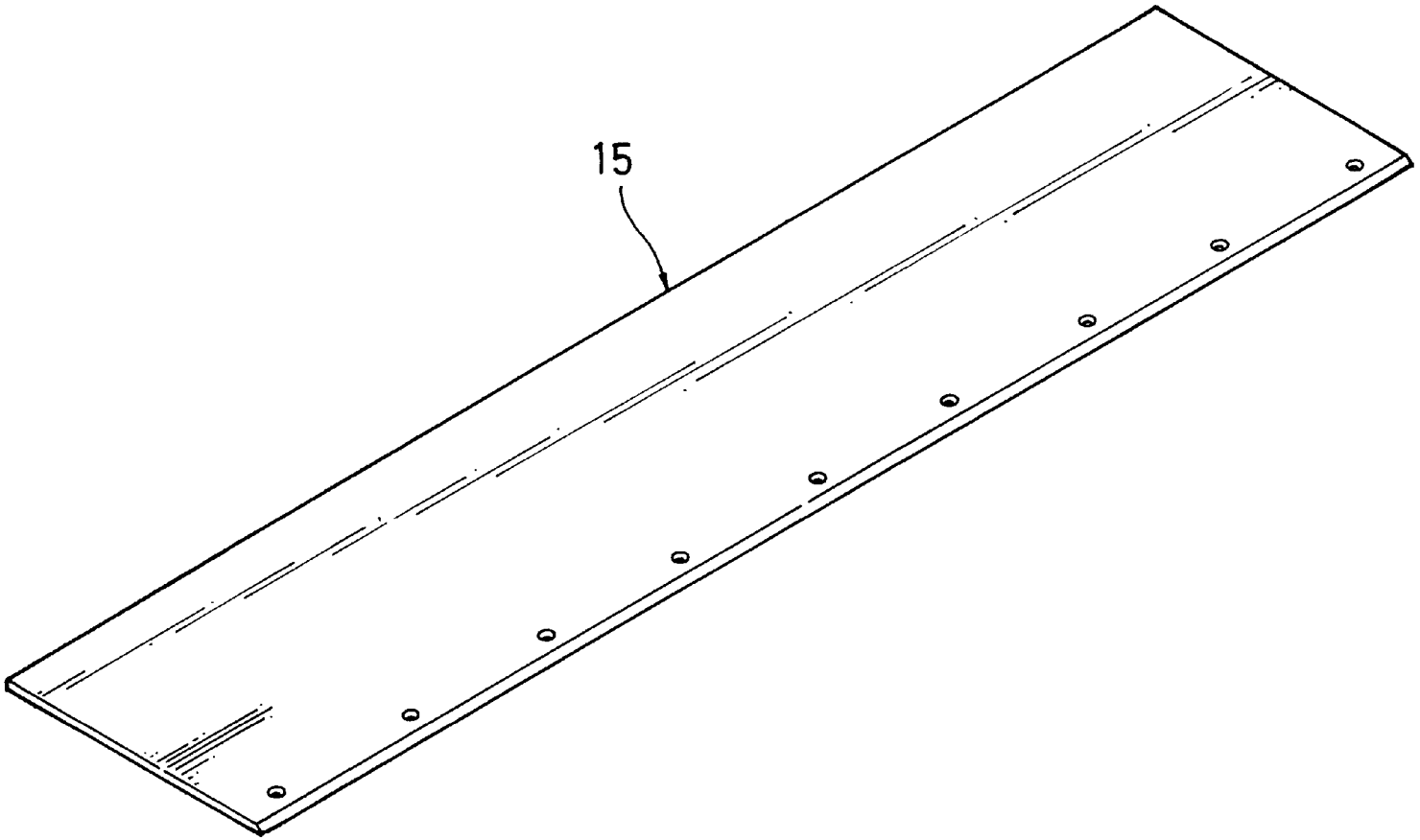
FIG. 8 is a perspective view of a cover plate the according to the first embodiment of the present invention.
Figure 9:
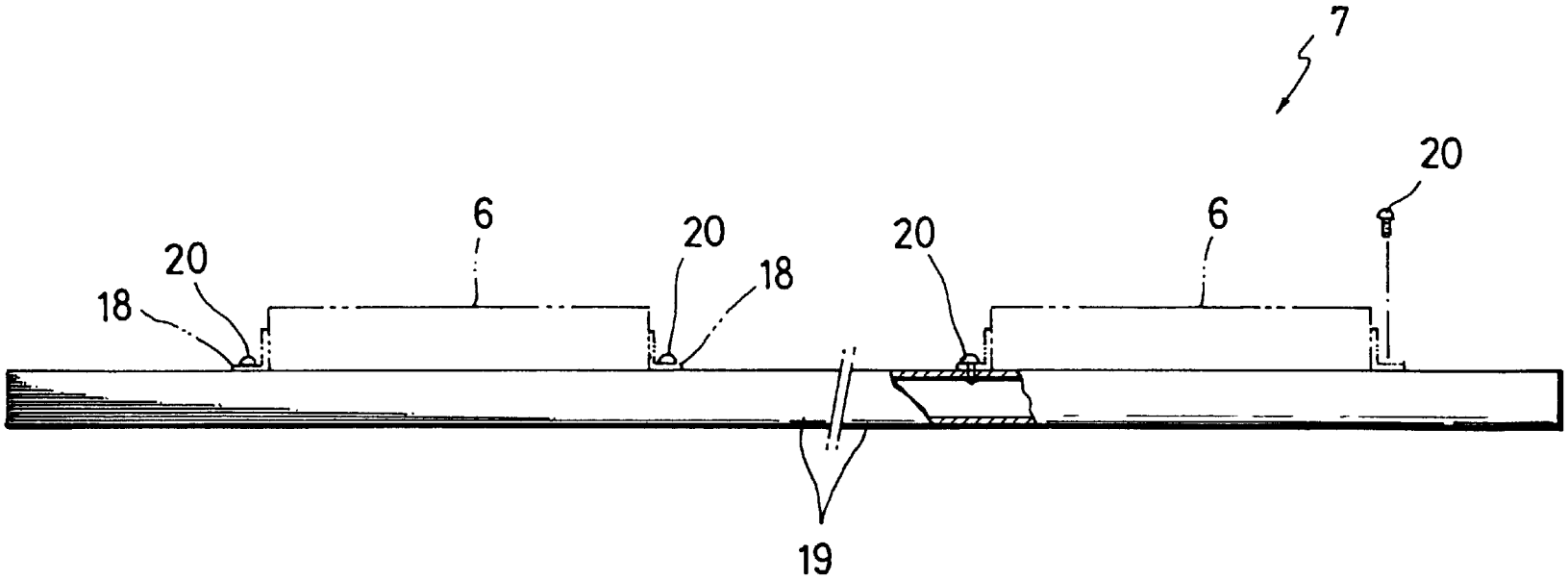
FIG. 9 is partly exploded side view of a connector according to the first embodiment of the present invention.

A joint plate 13 is attached covering the support members 6 by flat head screws 9, or the like. Ends of the joint plate 13 project to cover a part of the end joint plates 11,11 as shown in FIG. 7. Cover plates 15,15, as shown in FIG. 8, are fixed to floor surfaces 3*b*, 3*b* of right and left building portions 3,3 by a plurality of flat head fixing screws 14 to cover upper parts of the recessed portions 4, 4. The cover plates 15, 15 cover the joint plate 13 and ends of the end joint plates 11,11.

At least two or more central retaining devices 16, 16 maintain a central part of the support members 6 at a central position of the joint 2.The support members 6, as shown in FIGS. 4 and 5, are suitably fixed by angle-shaped mounting brackets 18,18 at substantially central portions of both sides of a frame of a support member body 17 by welding, or the like. The connecting device 7 includes a pipe 19 of a square shape disposed at the substantially central part on bottom surface of the support members 6 and screws 20 fix together the pipe 19 and the mounting brackets 18.

Bias devices 12, 12, as shown in FIG. 10, include extendable bars 21, 21 which are slidably disposed in end portions of the pipe 19 of the connecting device 7. Biasing springs 22, 22 bias the bars 21 outwardly. Stoppers 23,23 control the projecting length of the bars 21. Pivot pins 24, 24, attached to tip portions of the bars 21,21, pivotably engage the substantially central part of the outside of the end support members 8,8.

Figure 11:
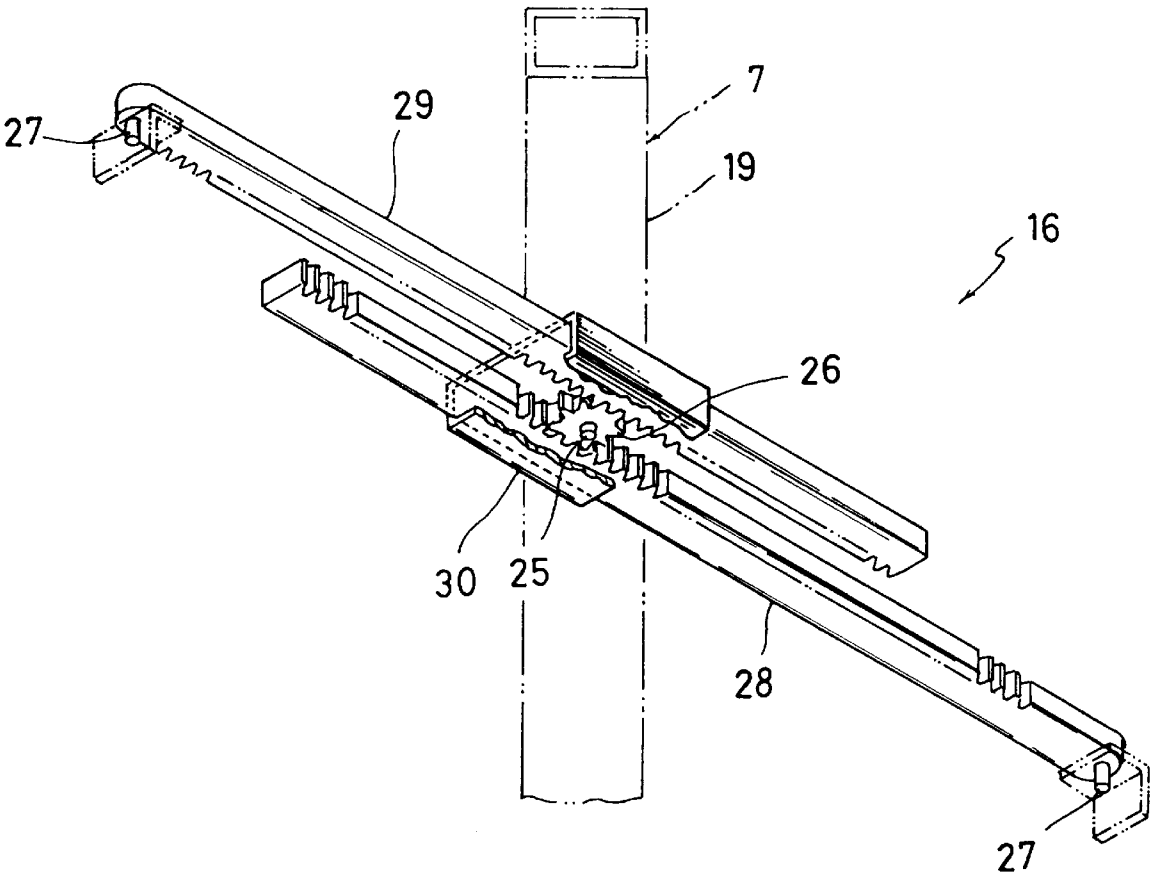
FIG. 11 is perspective view of a central retaining device according to the first embodiment of the present invention.

Referring to FIG. 11, each of the central retaining devices 16 further comprises a pinion 26, first rack 28, second rack 29, and a guide tube 30. The pinion 26 is provided pivotably mounted to the pipe 19 by a pivot pin 25. First rack 28 engages the pinion 26 and one end of the first rack 28 pivotably connects to a body 3*c* of one of the building portions 3. Also, the second rack 29 engages the pinion 26 and one end of the second rack 29 pivotably connects to a body 3*c* of the other building member 3. In addition, the guide tube 30 is pivotably mounted by the pivot pin 25 and slidably supports the first and second racks 28 and 29 to maintain pinion engagement of the pinion 26, the first rack 28, and the second rack 29.

Figure 12:
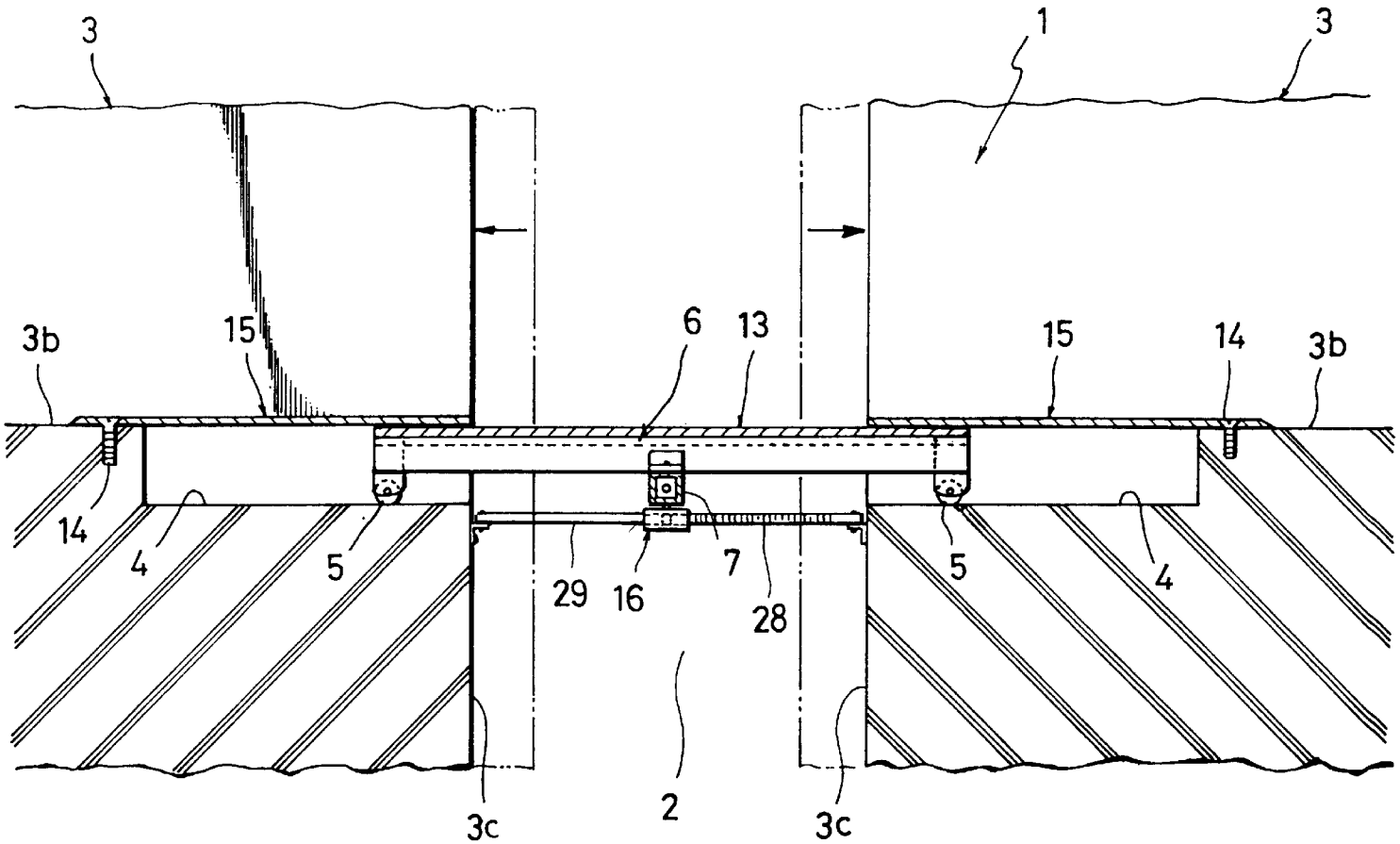
FIG. 12 is partial cross-sectional view showing joint expansion according to the first embodiment of the present invention.
Figure 13:
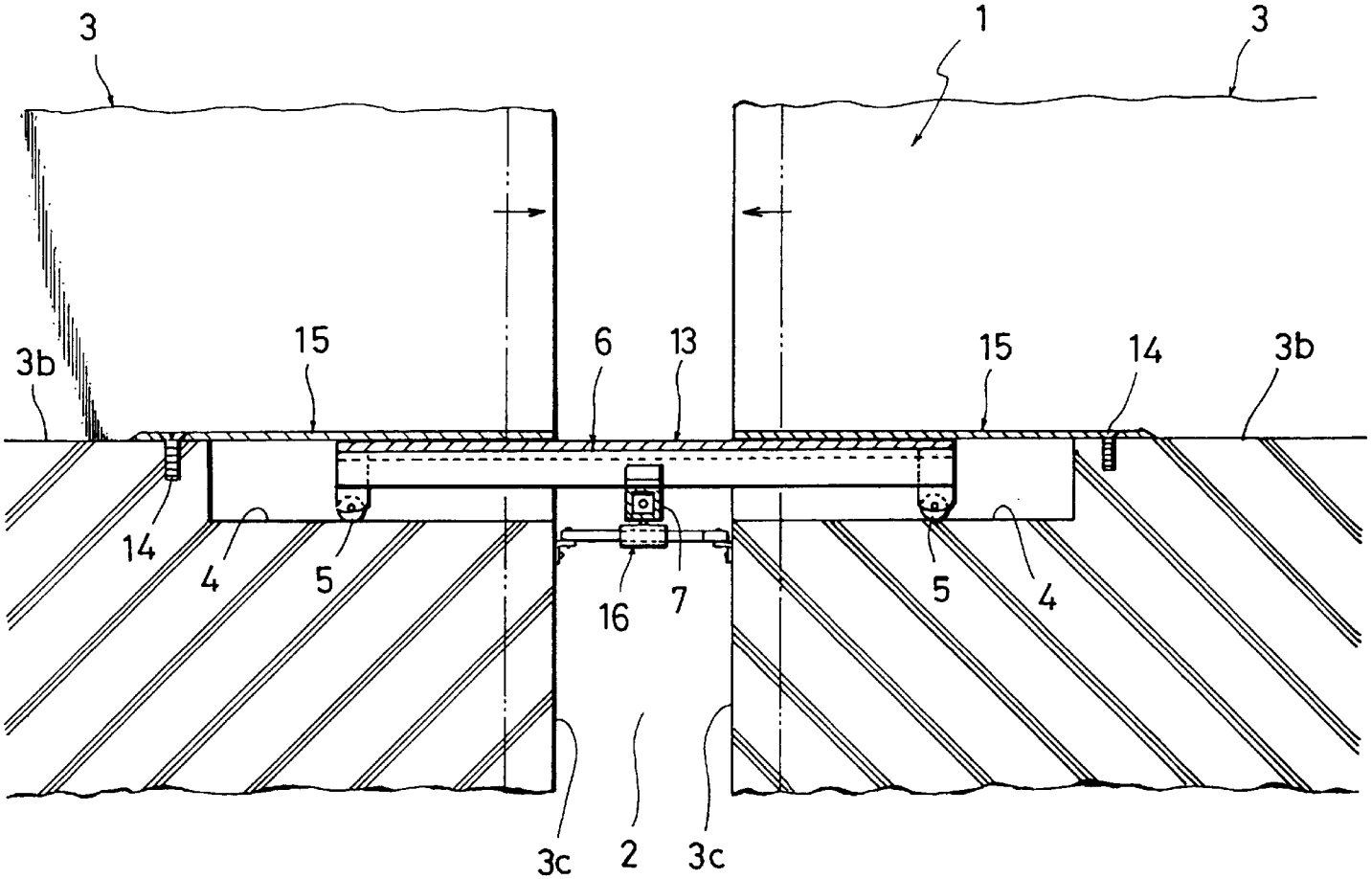
FIG. 13 is partial cross-sectional view showing joint contraction according to the first embodiment of the present invention.

In the above joint device 1, when right and left building portions 3,3 are oscillated by an earthquake, or the like, such that the width of the joint 2 between two building portions 3,3 expands or contracts, the plurality of support members 6 and end support member 8, as shown in FIGS. 12 and 13, move along the recessed portions 4, 4 in the right-left direction simultaneously relative the recessed portions 4, 4 to absorb the oscillation movement.

In such a situation, the square-shaped pipe 19 is always maintained at the central part of the joint 2 by the central retaining devices 16,16 attached to the pipe 19 of the connecting tool 7, so that the central portion of the support members 6 and end support members 8, 8, that is, the joint plate 13 or end joint plates 11,11 are located at the central part of the joint 2, and the recessed portions 4,4 received these plates 13, 11 in a balanced condition.

Figure 14:
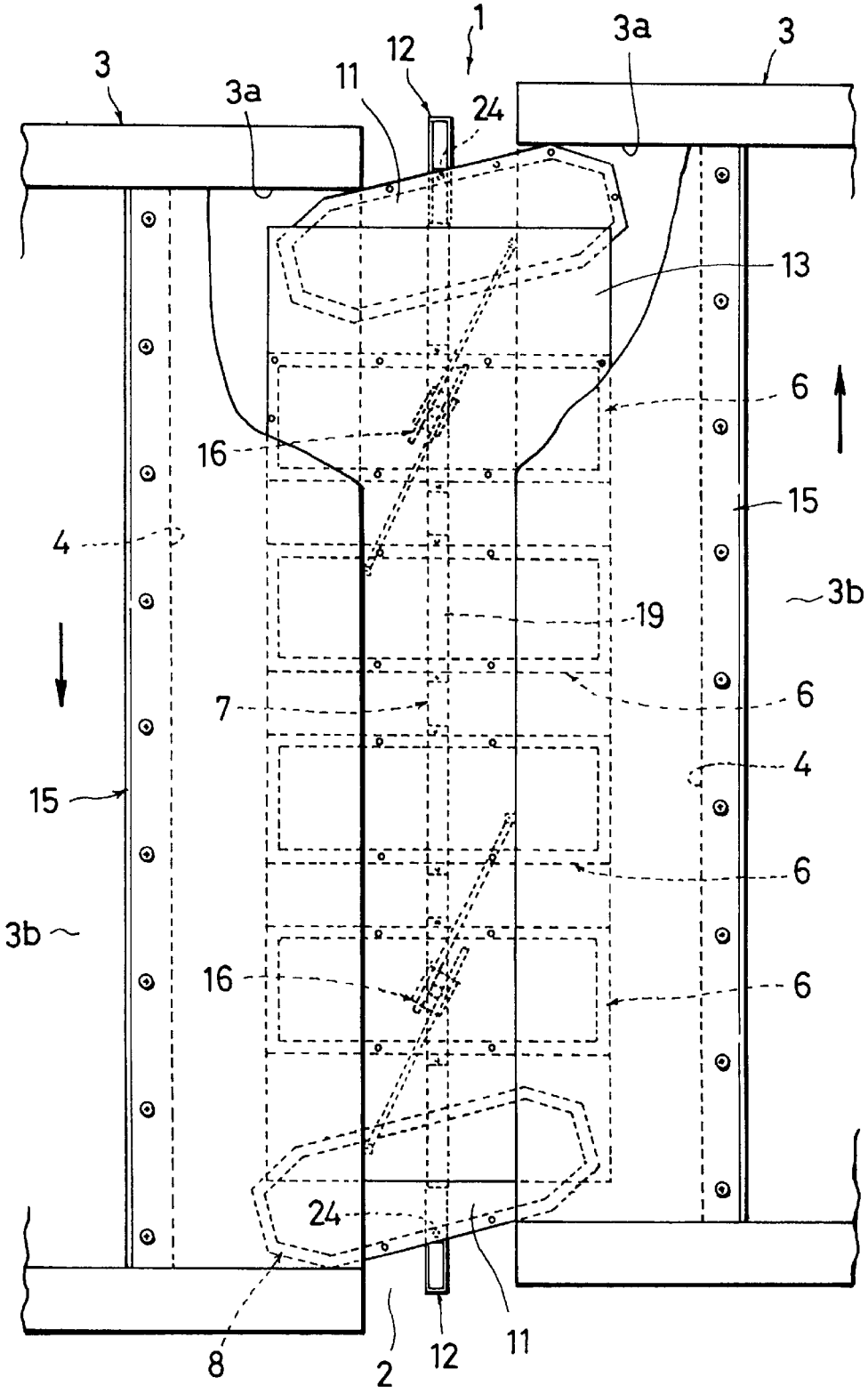
FIG. 14 is plan view showing movement of building portions in a back-and-forth direction.
Figure 15:
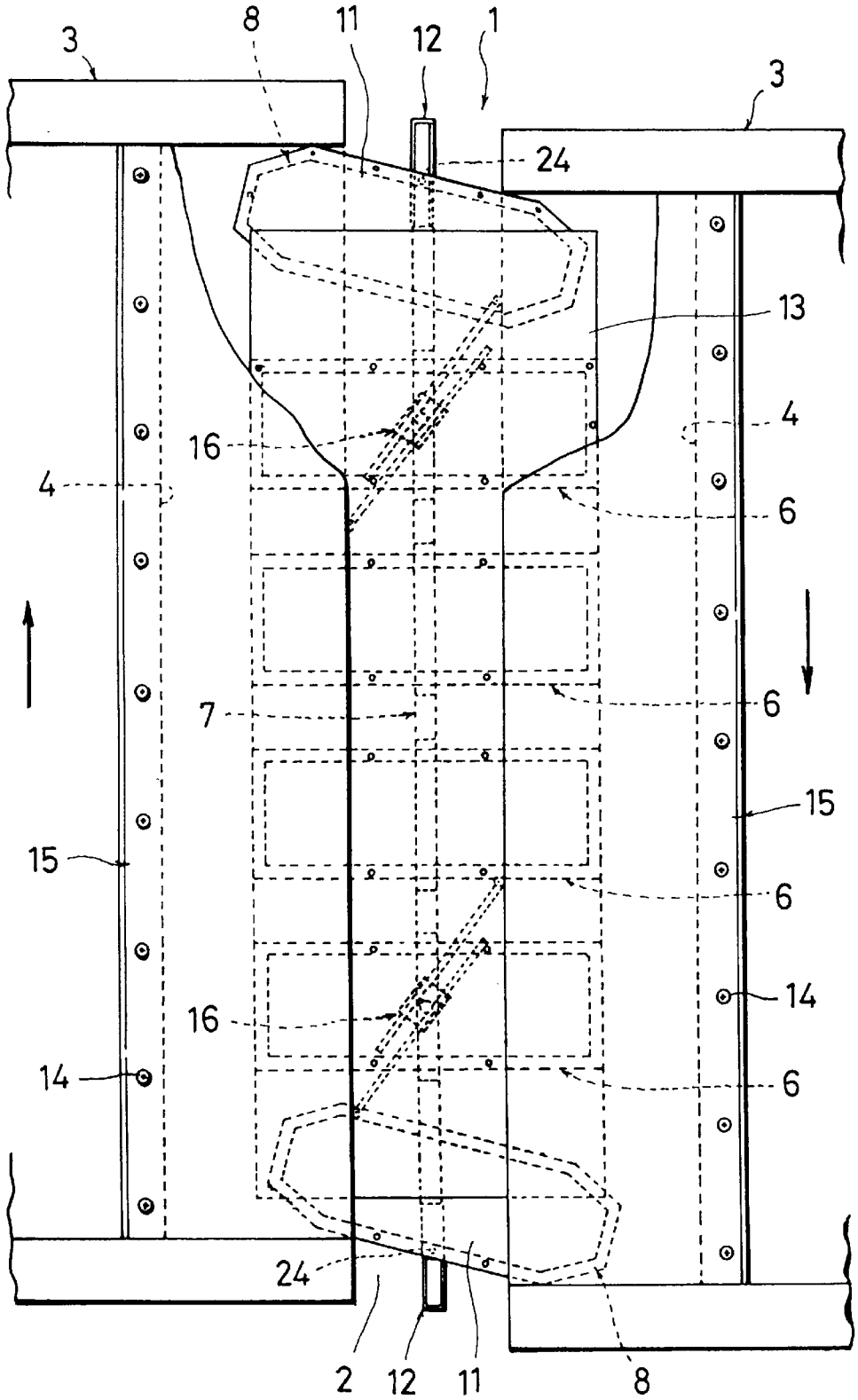
FIG. 15 is plan view showing movement of building portions in a direction opposite of that of FIG. 14.
Figure 16:
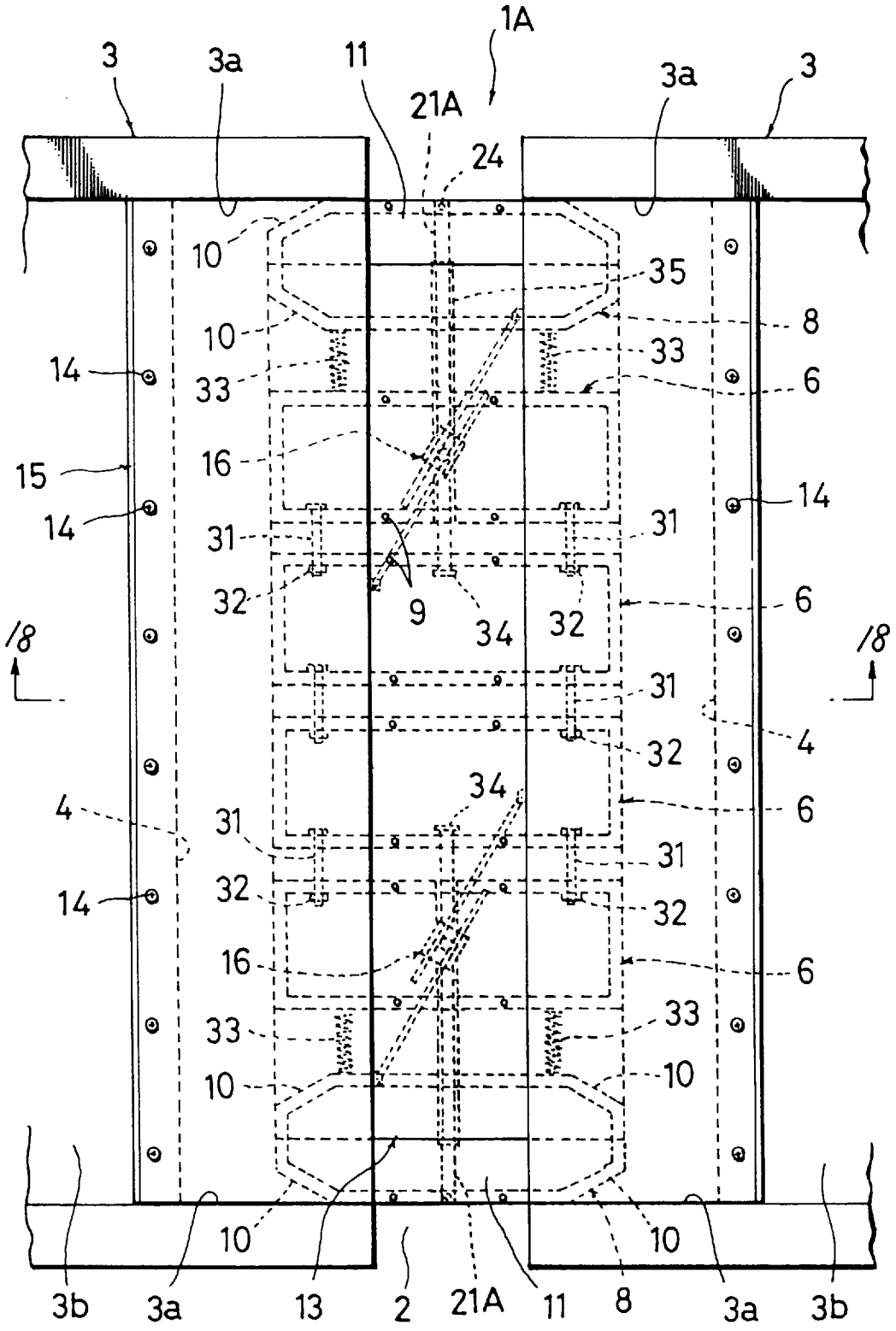
FIG. 16 is a plan view showing a second embodiment of the present invention.
Figure 17:
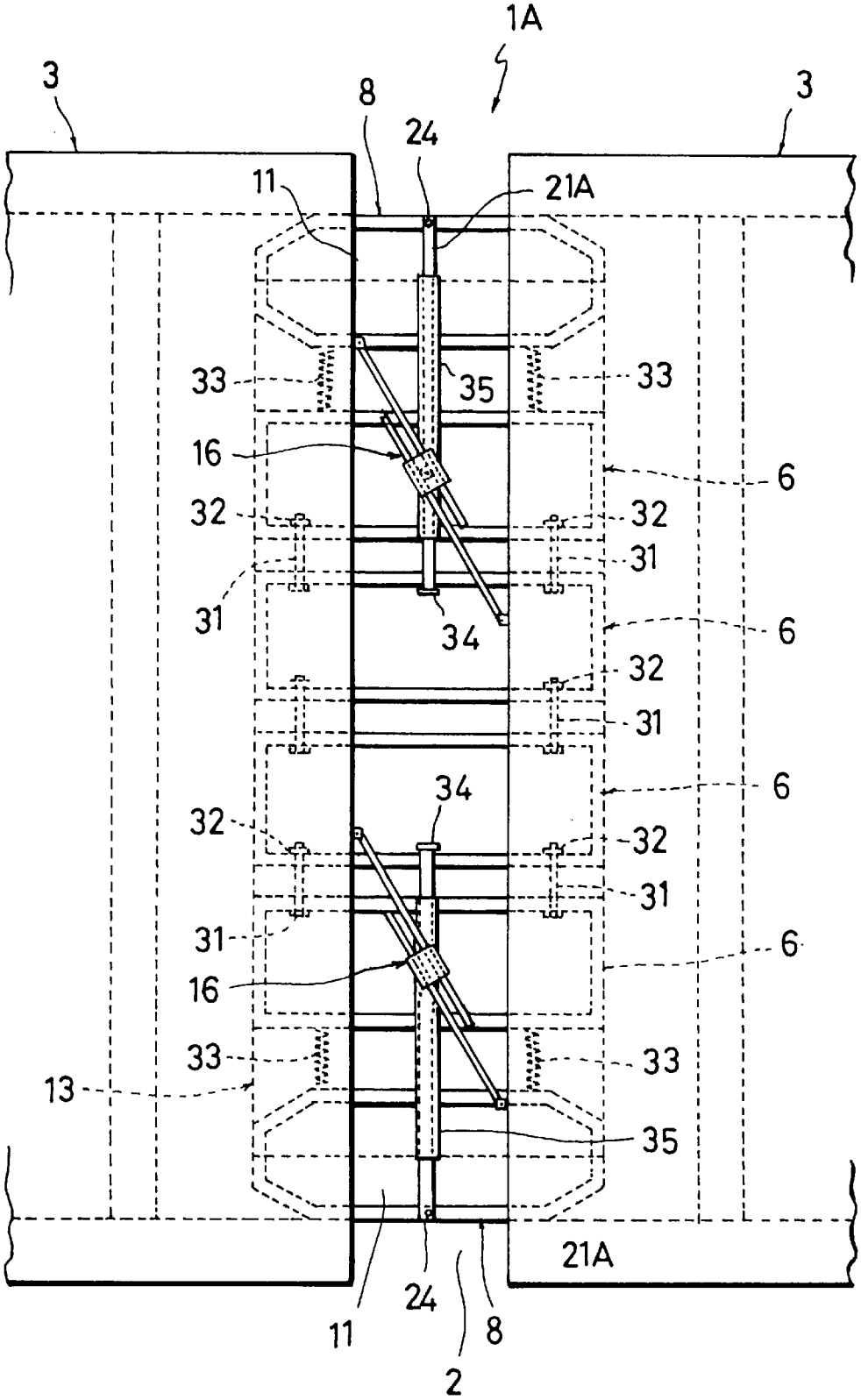
FIG. 17 is a bottom view showing the second embodiment of the present invention.
Figure 18:
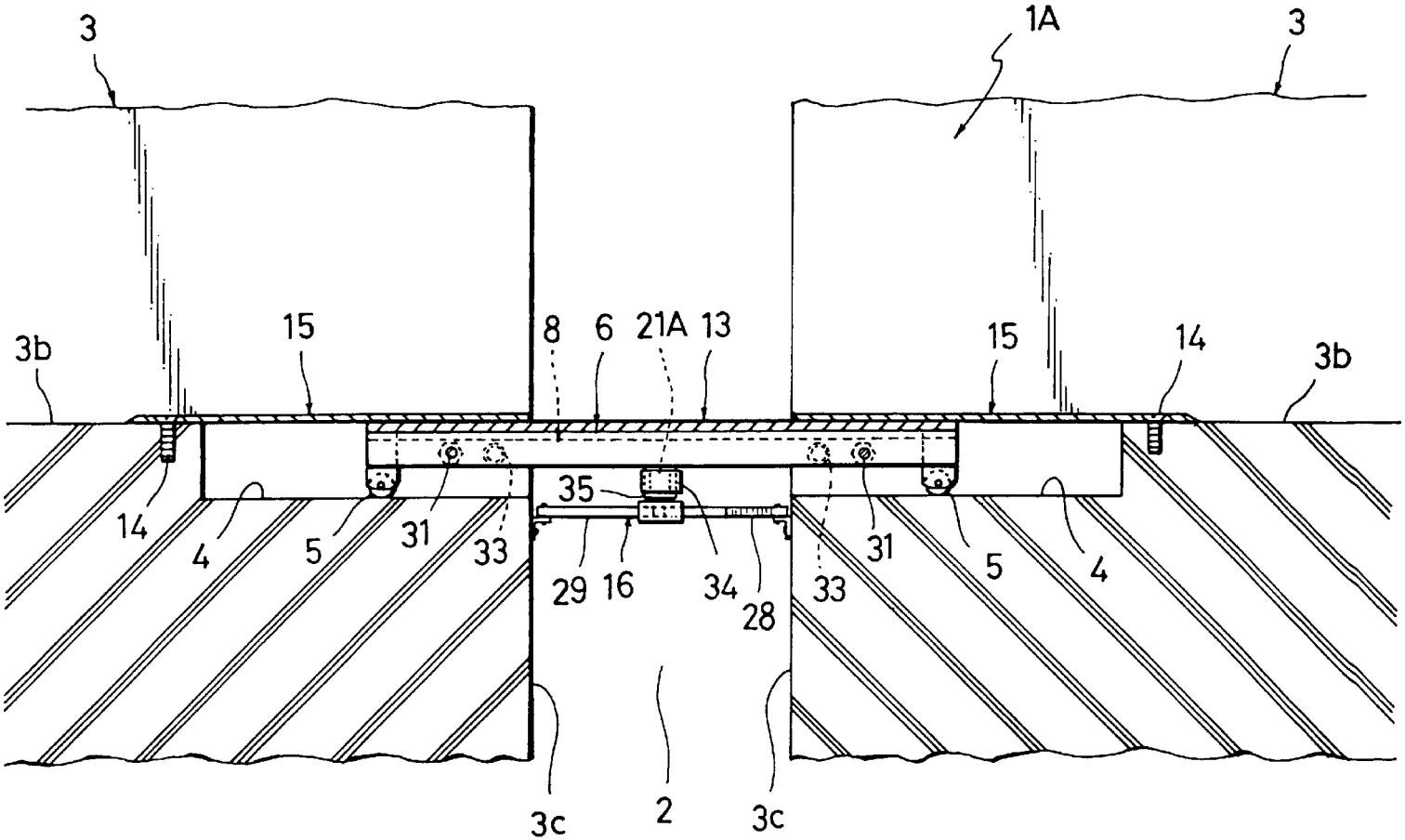
FIG. 18 is an expanded cross-sectional view taken along the line 18—18 of FIG. 16.
Figure 19:
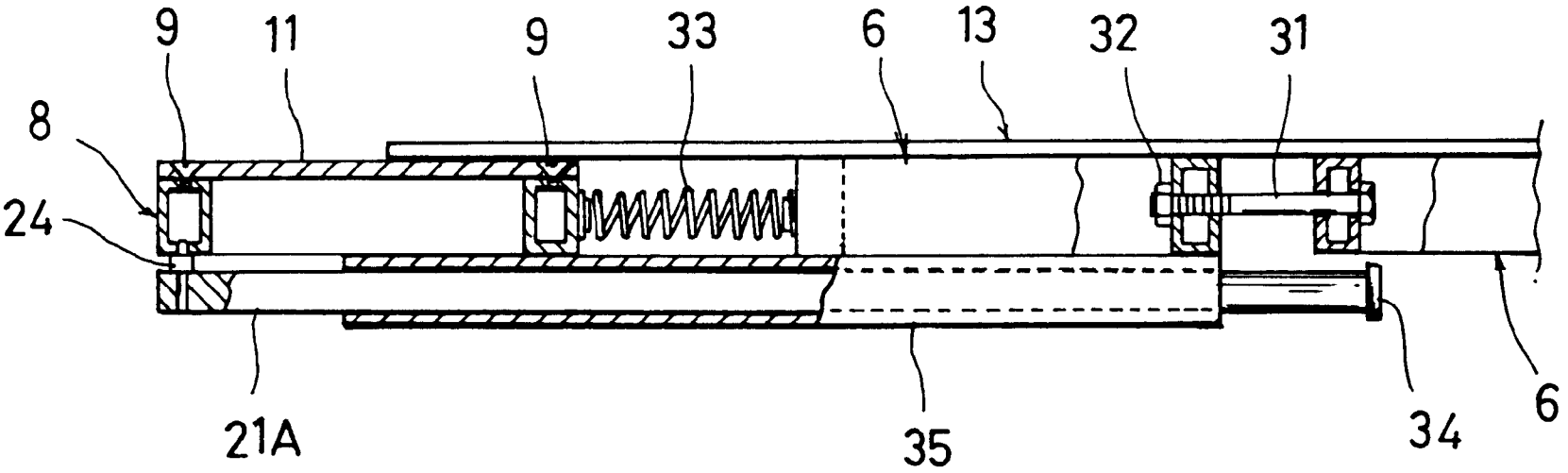
FIG. 19 is a partial cross-sectional view of a device for biasing an end support member of the second embodiment of the present invention.

Referring to FIGS. 14 and 15, when the right and left building portions 3,3 are oscillated by an earthquake, or the like, along a back-and-forth direction in opposing directions, the joint device 1 of the present invention follows the swing or oscillation movement because outer end portions of the end joint plates 11,11 rotate on the pivot pins 24, 24 due to pressure of the wall surfaces 3*a*, 3*a* of right and left building portions 3,3. Thus, no gap between the end joint plates 11,11 and right and left building portions 3,3 is produced because the end joint plates 11,11 are biased by the biasing devices 12,12, so as to project always outwardly.

Other embodiments of the present invention are described below with reference to FIGS. 16 to 40. Throughout the drawings of the embodiments, like components are denoted by like numerals as of the first embodiment and will not therefore be explained in greater detail.

FIGS. 16 to 19 illustrate a second embodiment of the present invention which is distinguished from the first embodiment by the fact that the plurality of support members 6 are connected loosely by bolts 31 and nuts 32, biasing springs 33,33,33,33 are interposed between the support members 6, 6 located at both ends and the end support members 8, 8. The biasing springs 33 bias outwardly each of the end support members 8, and support sleeves 35, 35 are respectively fixed to substantially central portions of the support members 6,6 located at both ends. The support sleeves 35,35 support respectively extendable bars 21A, 21A and end portions of the bars 21A have stoppers 34,34. Accordingly, a joint device 1A according to the second embodiment will function similar to the first embodiment.

Figure 20:
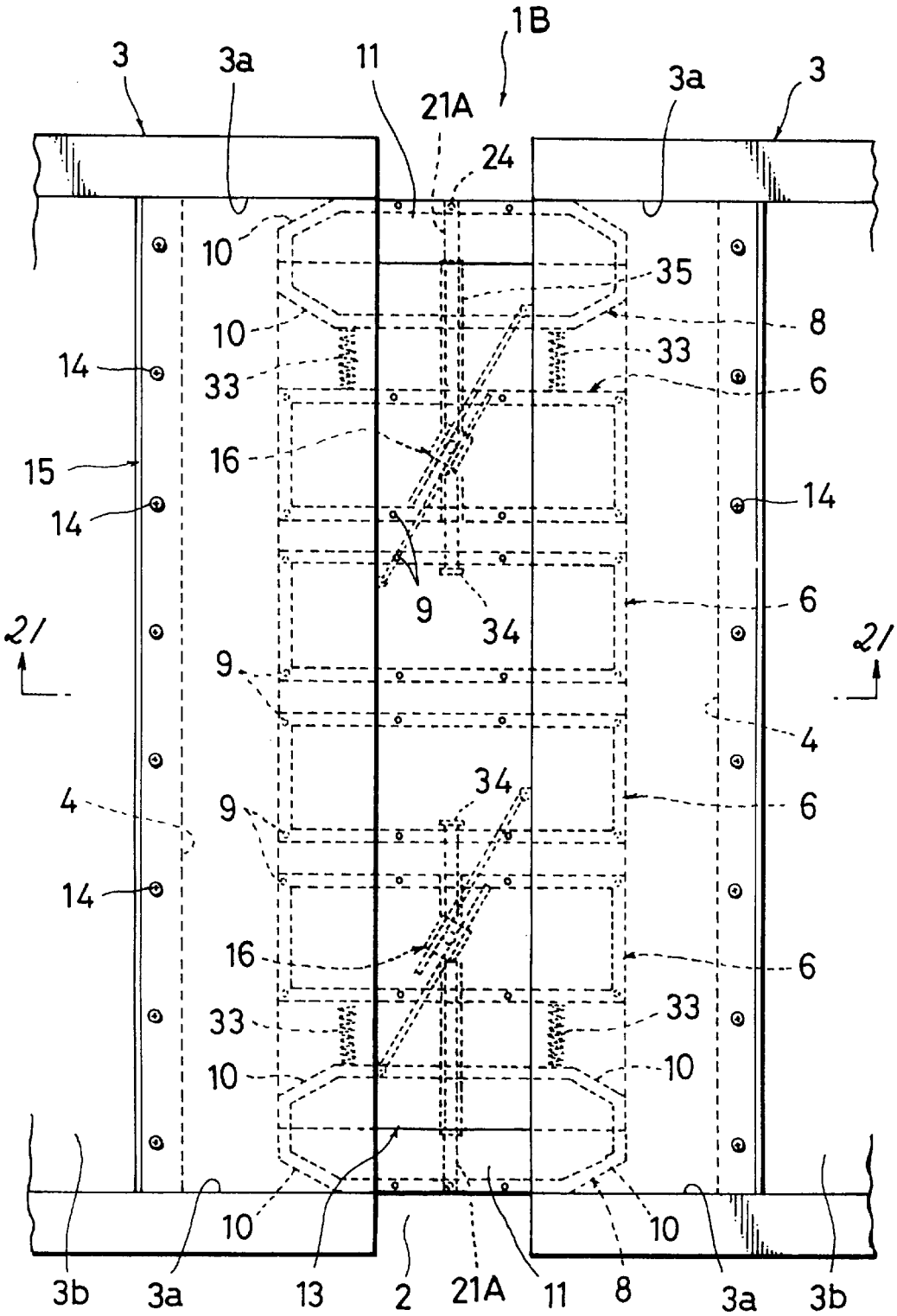
FIG. 20 is a plan view showing a third embodiment of the present invention.
Figure 21:
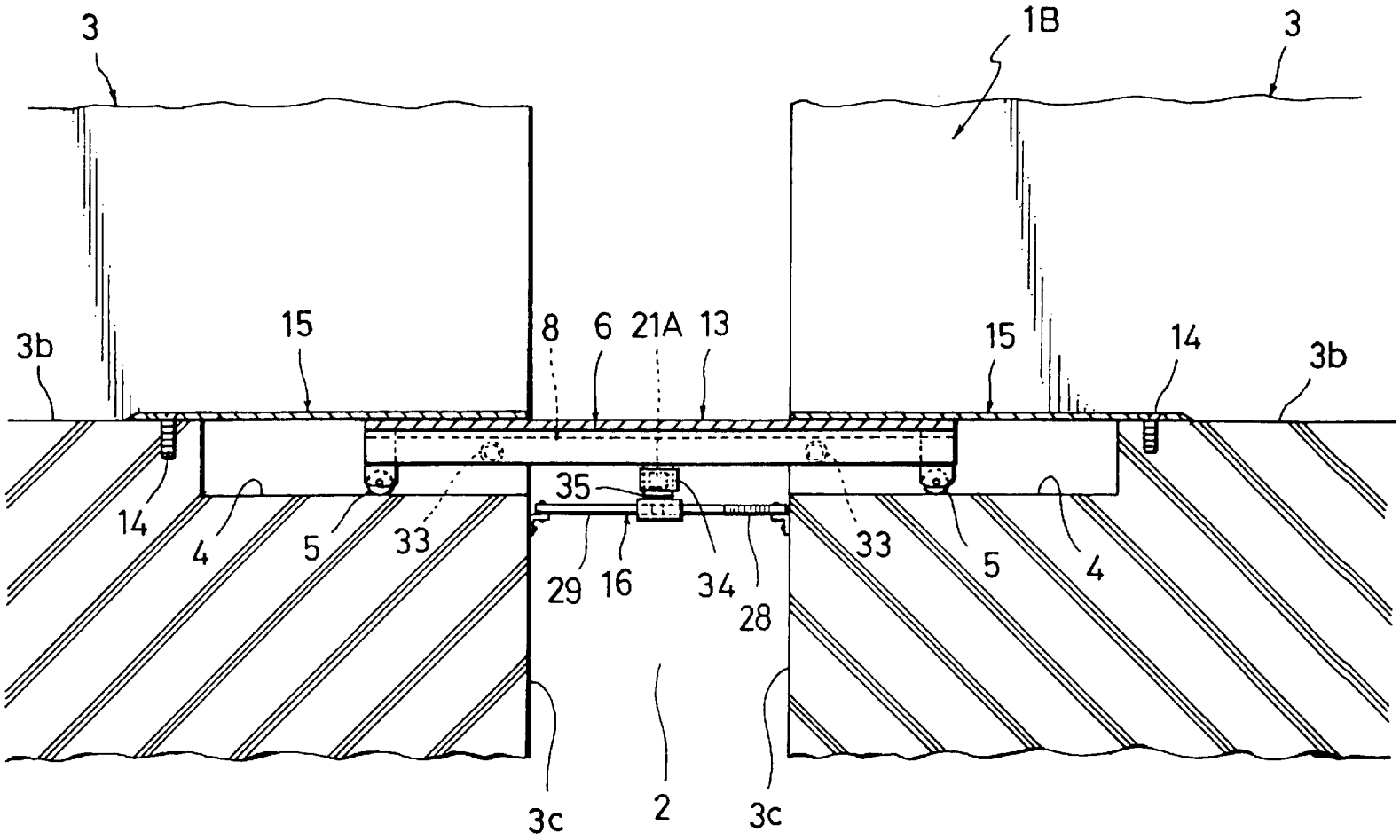
FIG. 21 is an expanded cross-sectional view taken along the line 21—21 of FIG. 20.
Figure 22:
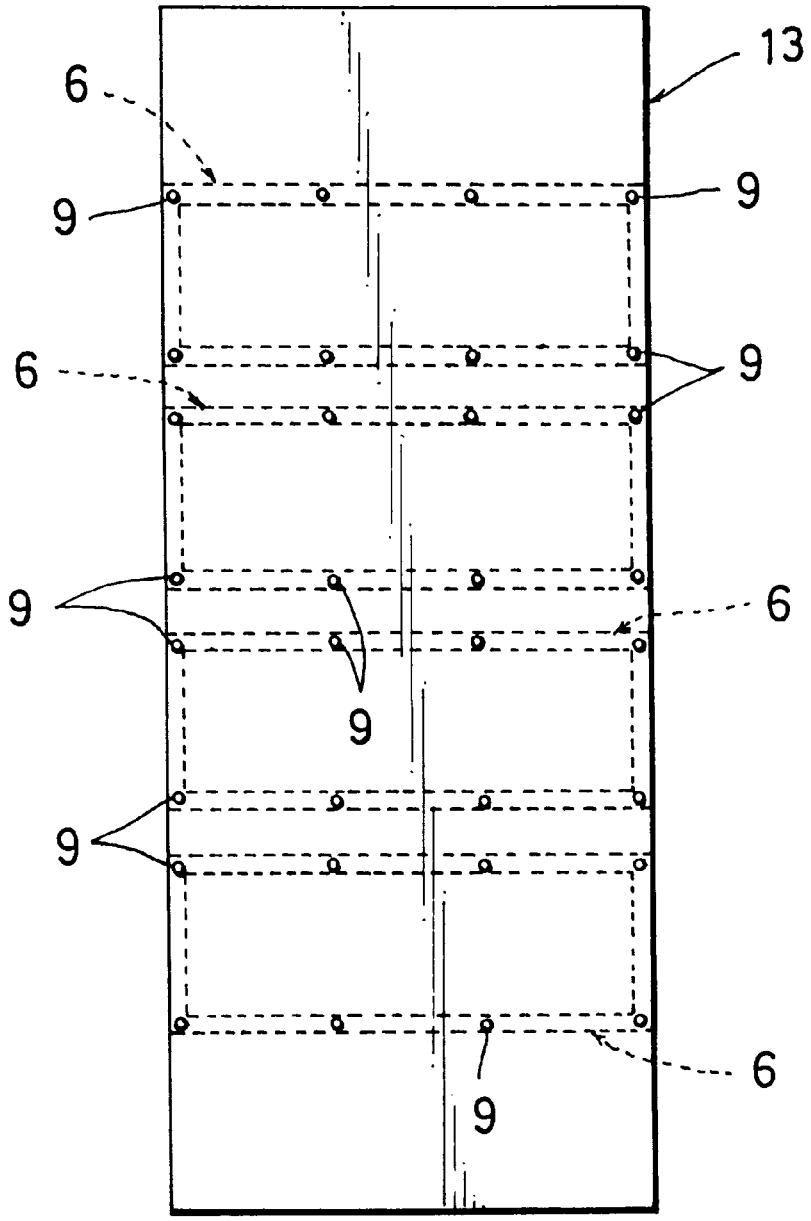
FIG. 22 is a plan view of a joint plate having a support member.

FIGS. 20 to 22 illustrate a third embodiment of the present invention which is distinguished from the second embodiment by the fact that the plurality of support members 6 is connected to the joint plate 13 by the plurality of flat head screws 9. Accordingly, a joint device 1B according to the third embodiment will function similar to the second embodiment.

Figure 23:
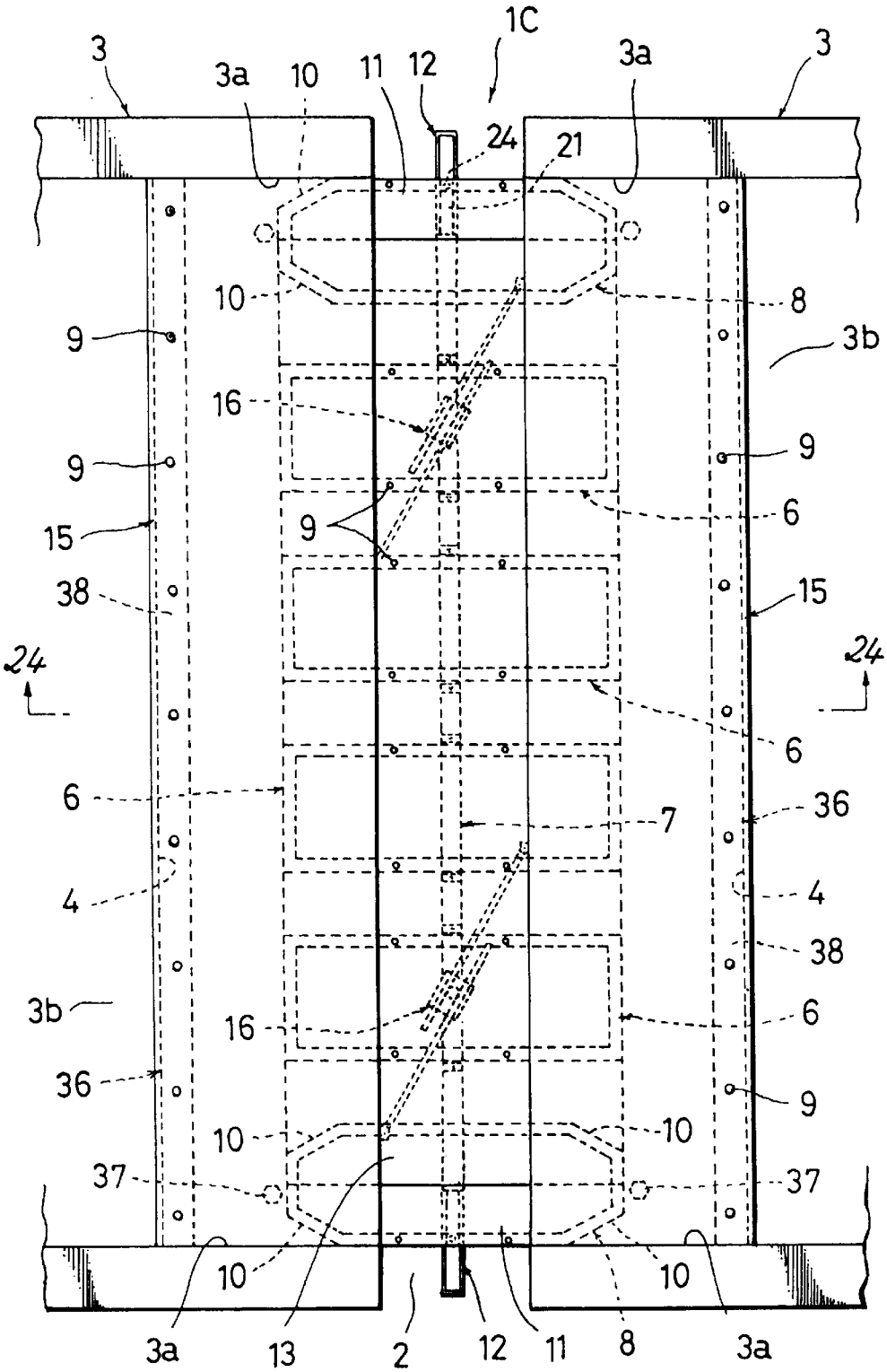
FIG. 23 is a plan view showing a fourth embodiment of the present invention.
Figure 24:
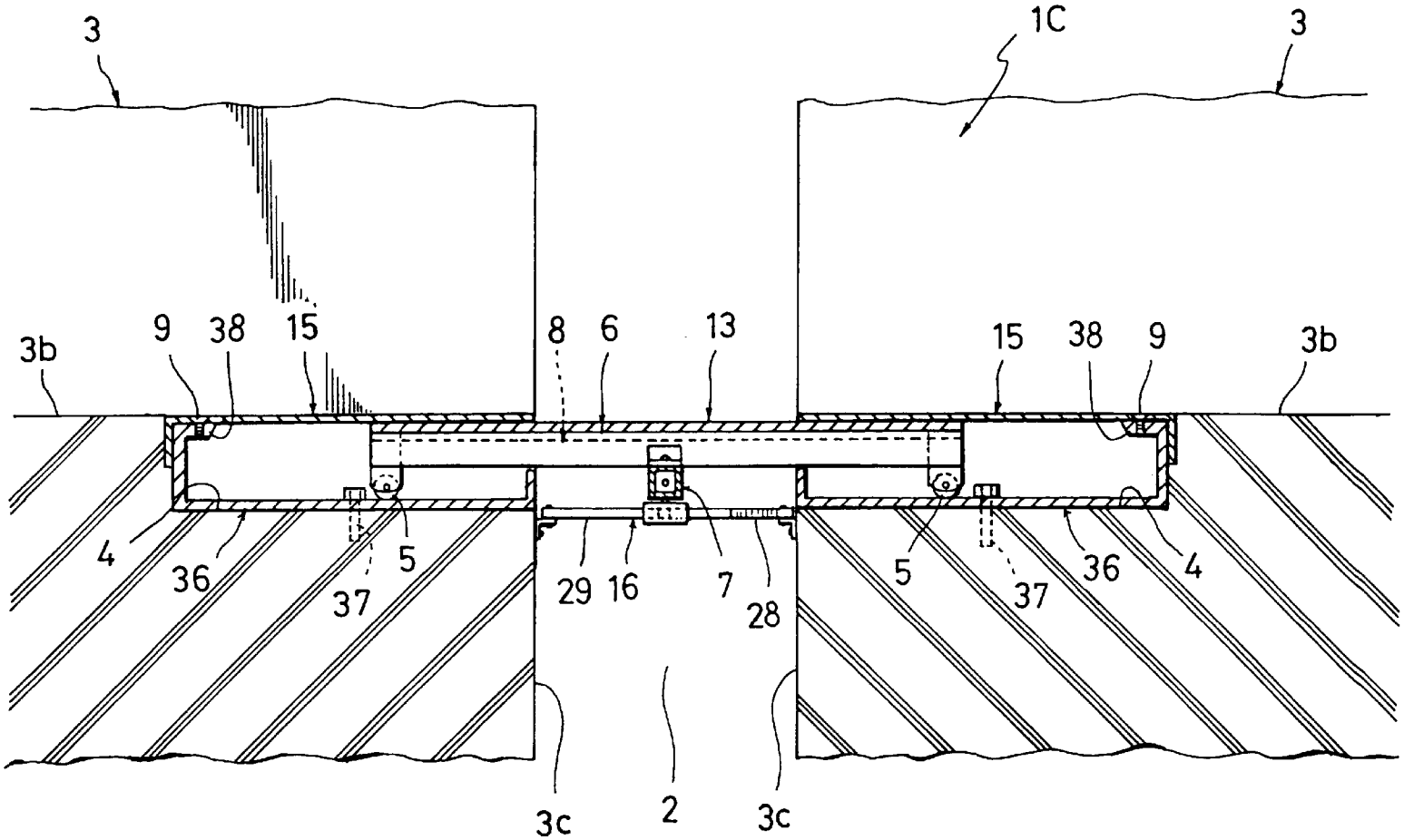
FIG. 24 is an expanded cross-sectional view taken along the line 24—24 of FIG. 23.
Figure 25:
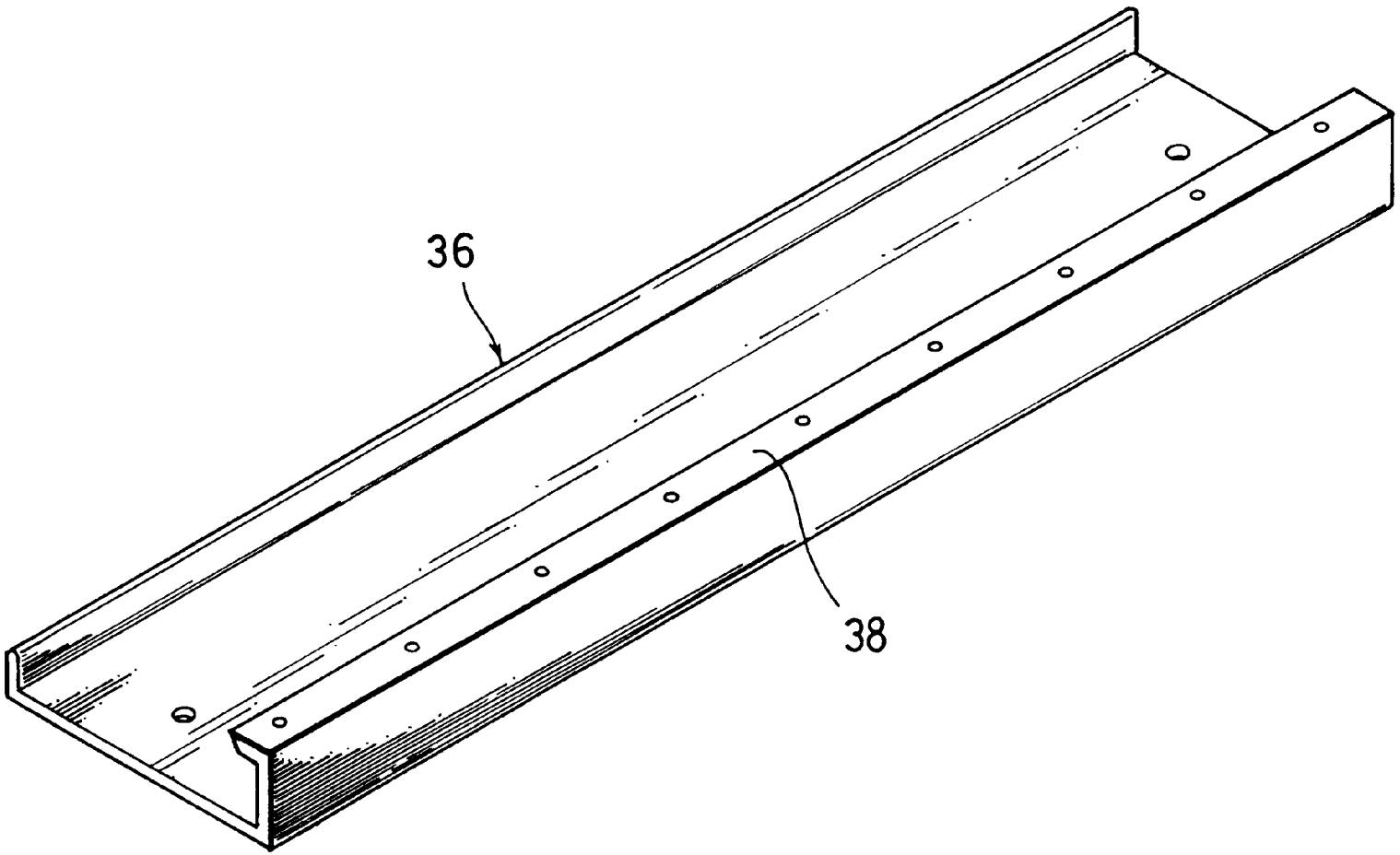
FIG. 25 is a perspective view of a substrate rail of the fourth embodiment of the present invention.
Figure 26:
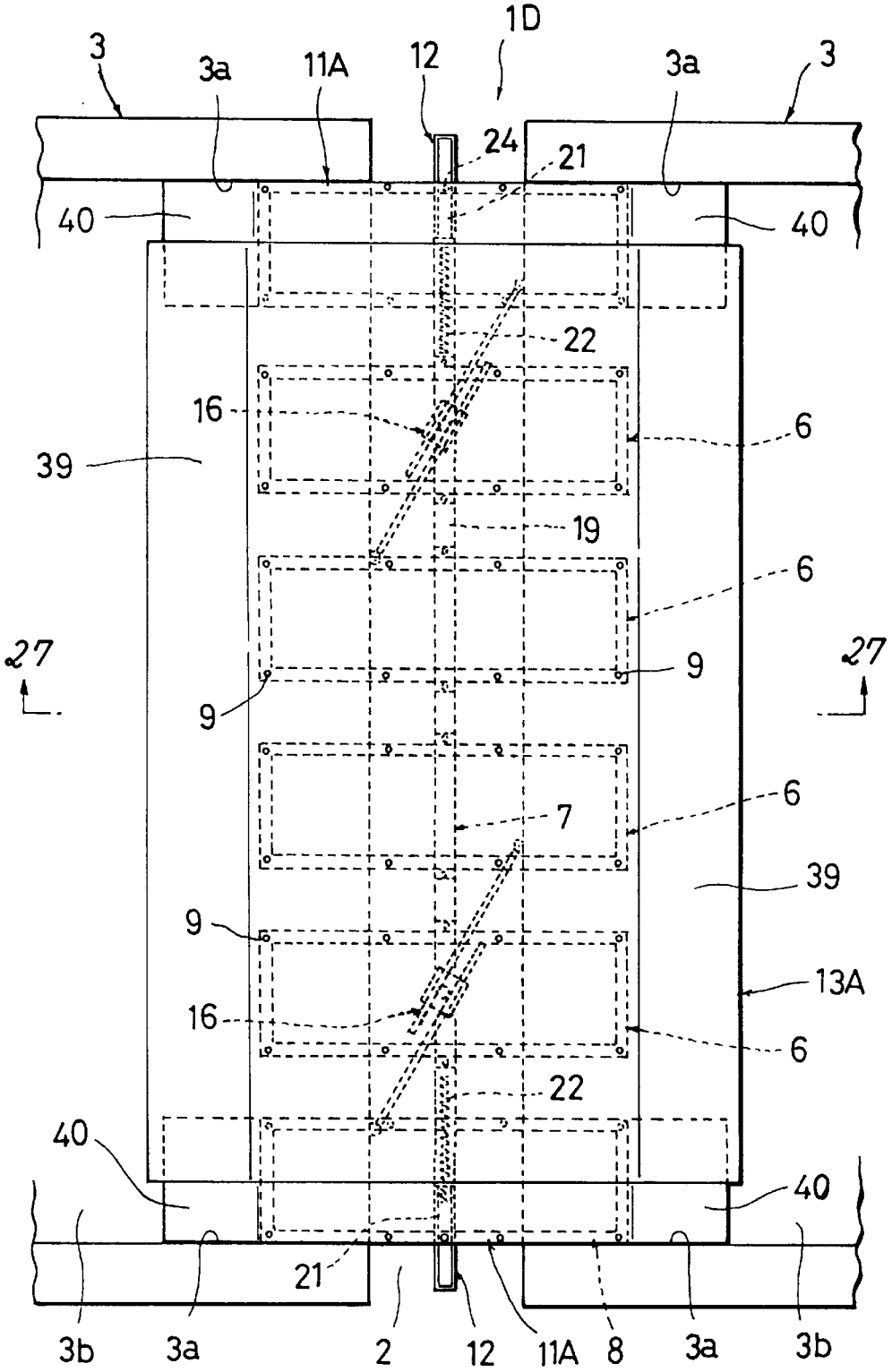
FIG. 26 is a plan view showing a fifth embodiment of the present invention.
Figure 27:
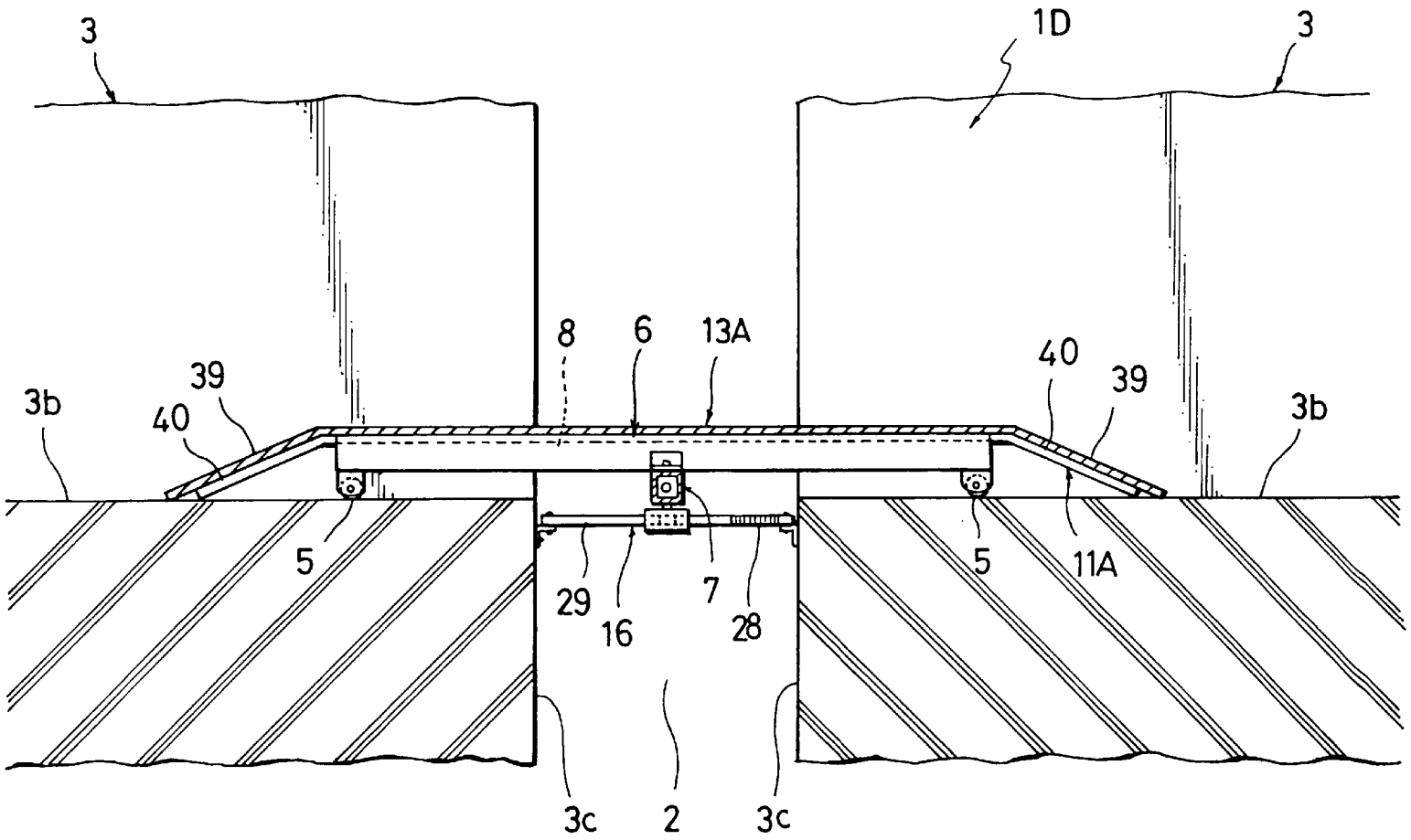
FIG. 27 is an expanded cross-sectional view taken along the line 27—27 of FIG. 26.
Figure 28:
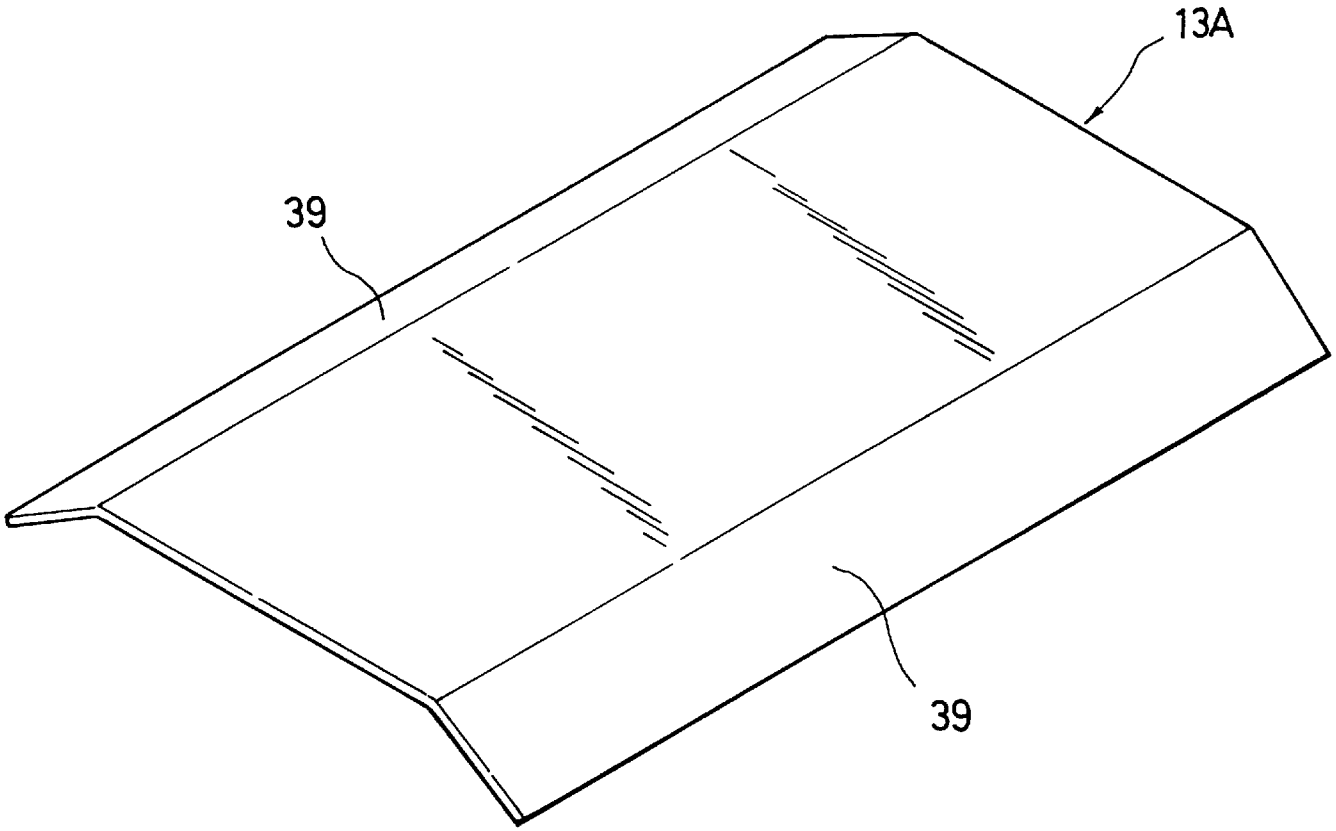
FIG. 28 is a perspective view of a joint plate showing the fifth embodiment of the present invention.
Figure 29:
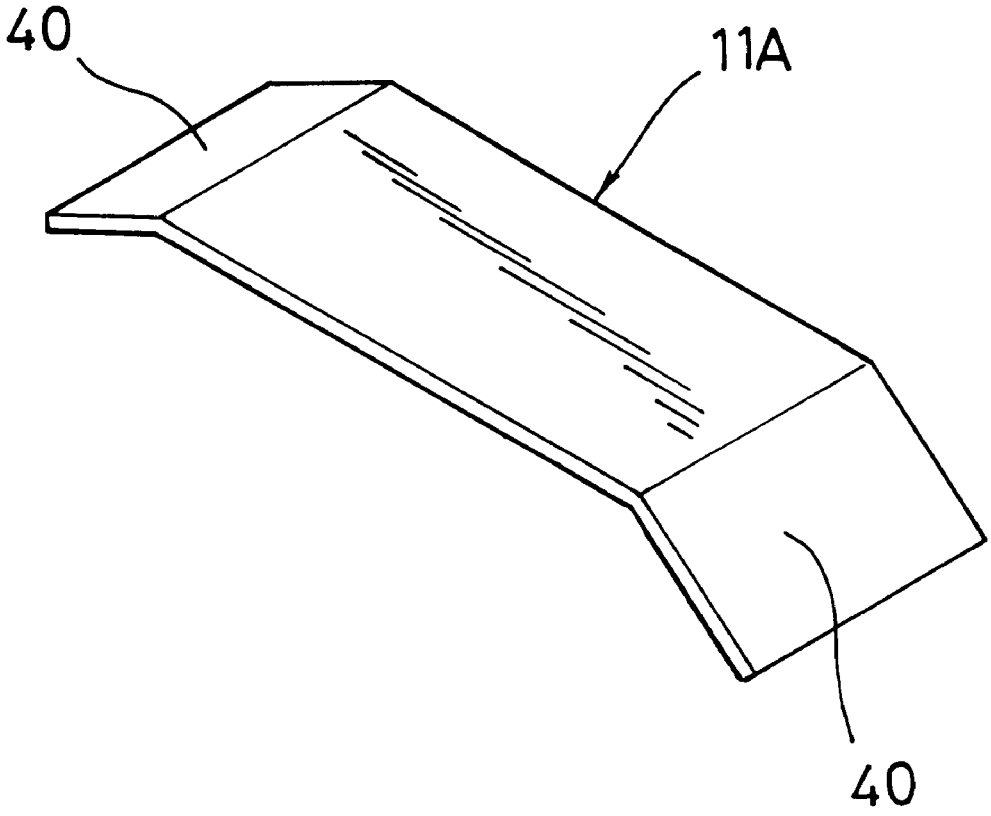
FIG. 29 is a perspective view of an end joint plate of the fifth embodiment of the present invention.

FIGS. 23 to 25 illustrate a fourth embodiment of the present invention which is distinguished from the first embodiment by the fact that the recessed portions 4, 4 receive fixedly substantially channel-shape substrate rails 36, 36 secured by a plurality of fixing bolts 37. The cover plates 15,15 are fixed to cover plate support portions 38, 38 of the substrate rails 36, 36 by flat head screws 9. Accordingly, a joint device 1C according to the fourth embodiment provides function similar to the first embodiment.

FIGS. 26 to 29 illustrate a fifth embodiment of the present invention which is distinguished from the first embodiment by the fact that the plurality of support members 6 and the end support members 8, 8 are disposed on right and left flat floor surfaces 3*b*, 3*b*. A joint plate 13A covers an upper portion of the support members 6 and is fixed by flat head screws 9, both side surfaces of the joint plate 13A being sloping surfaces, and side portions of end joint plates 11A, 11A covering the upper portion of the end support members 8, 8 are sloping surfaces 40, 40 allowing creep of the joint plate 13A during rotation. Accordingly, a joint device according to the fifth embodiment provides function similar to the first embodiment.

Figure 30:
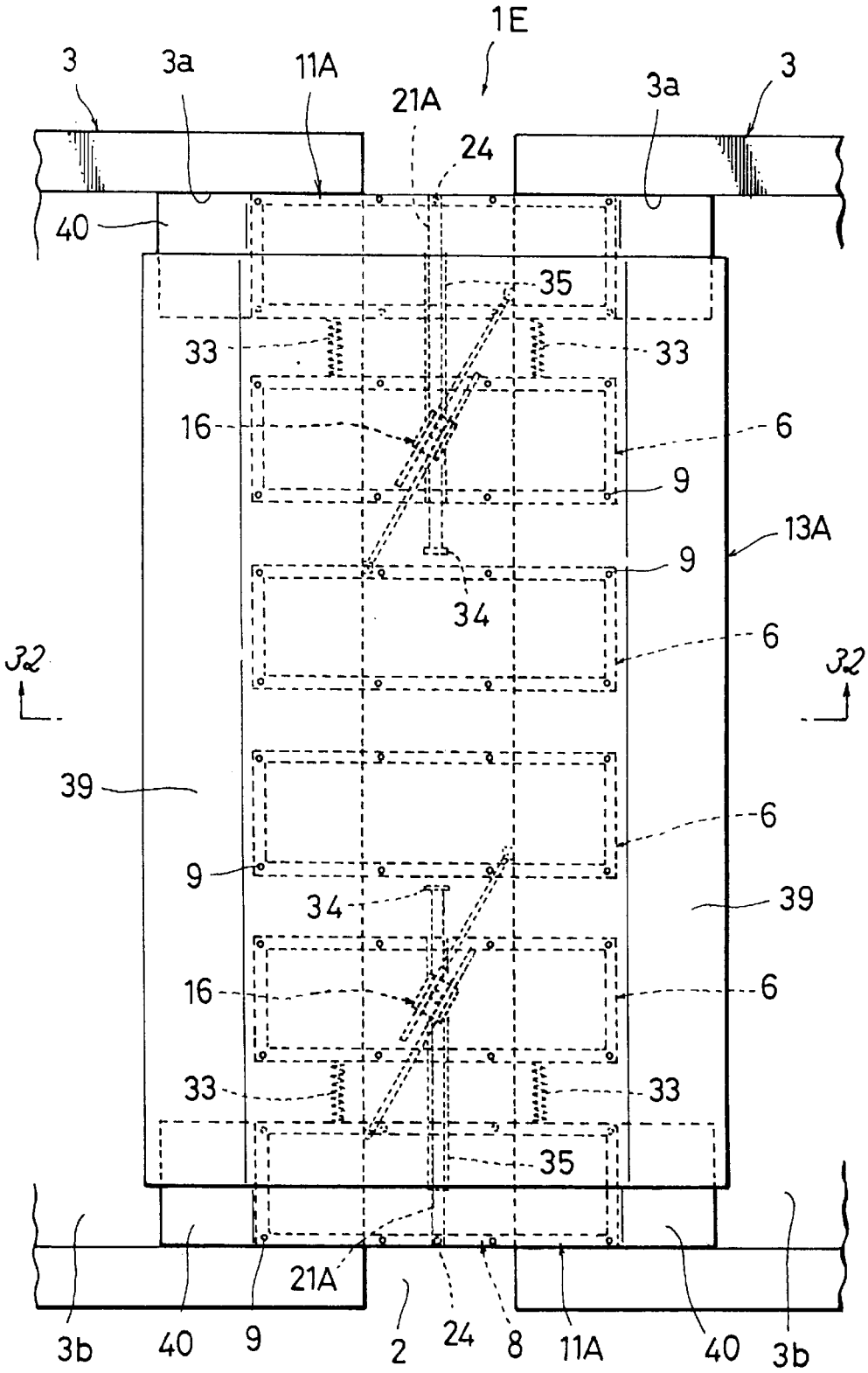
FIG. 30 is a plan view showing a sixth embodiment of the present invention.
Figure 31:
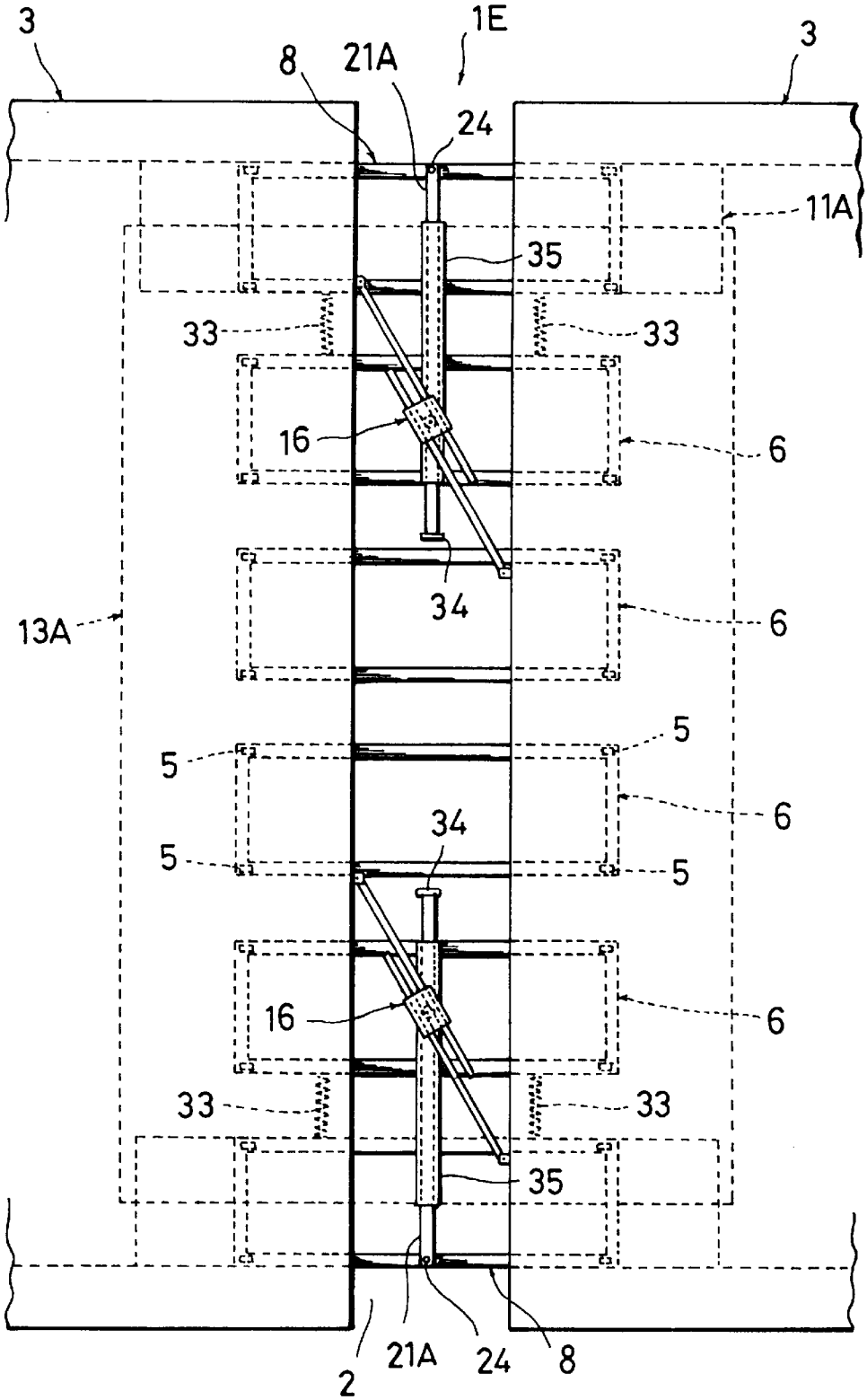
FIG. 31 is a bottom view showing the sixth embodiment of the present invention.
Figure 32:
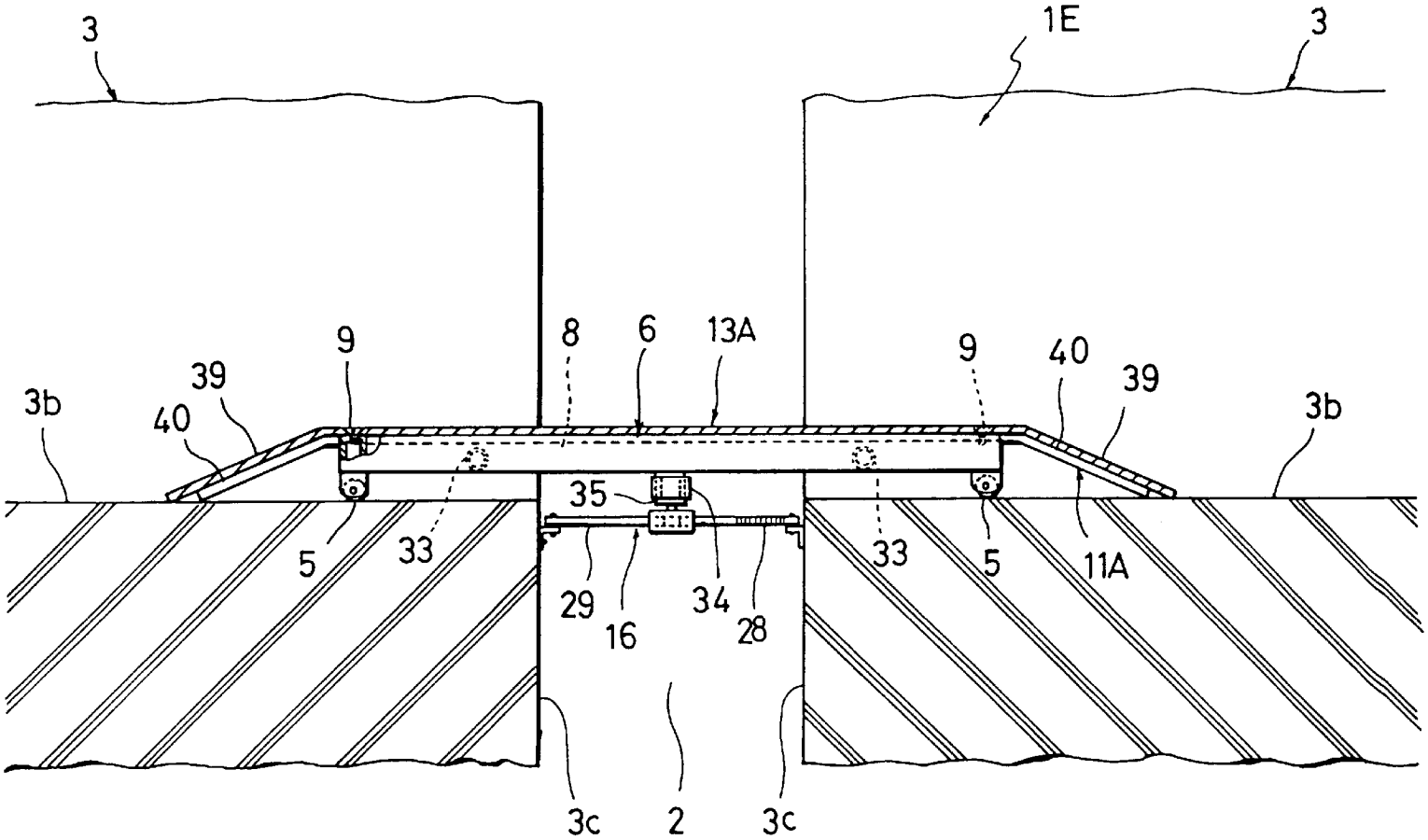
FIG. 32 is an expanded cross-sectional view taken along the line 32—32 of FIG. 31.
Figure 33:
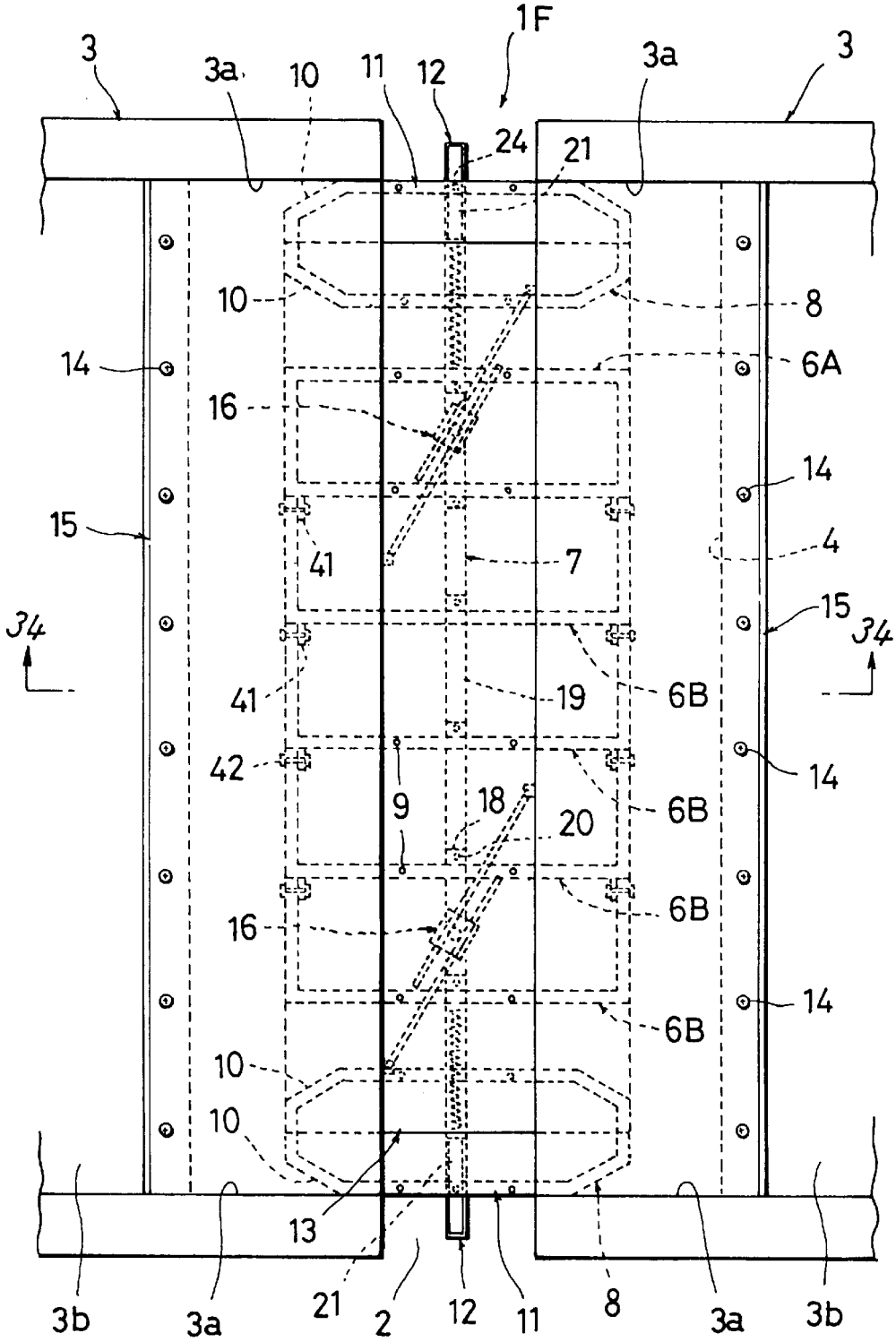
FIG. 33 is a plan view showing a seventh embodiment of the present invention.
Figure 34:
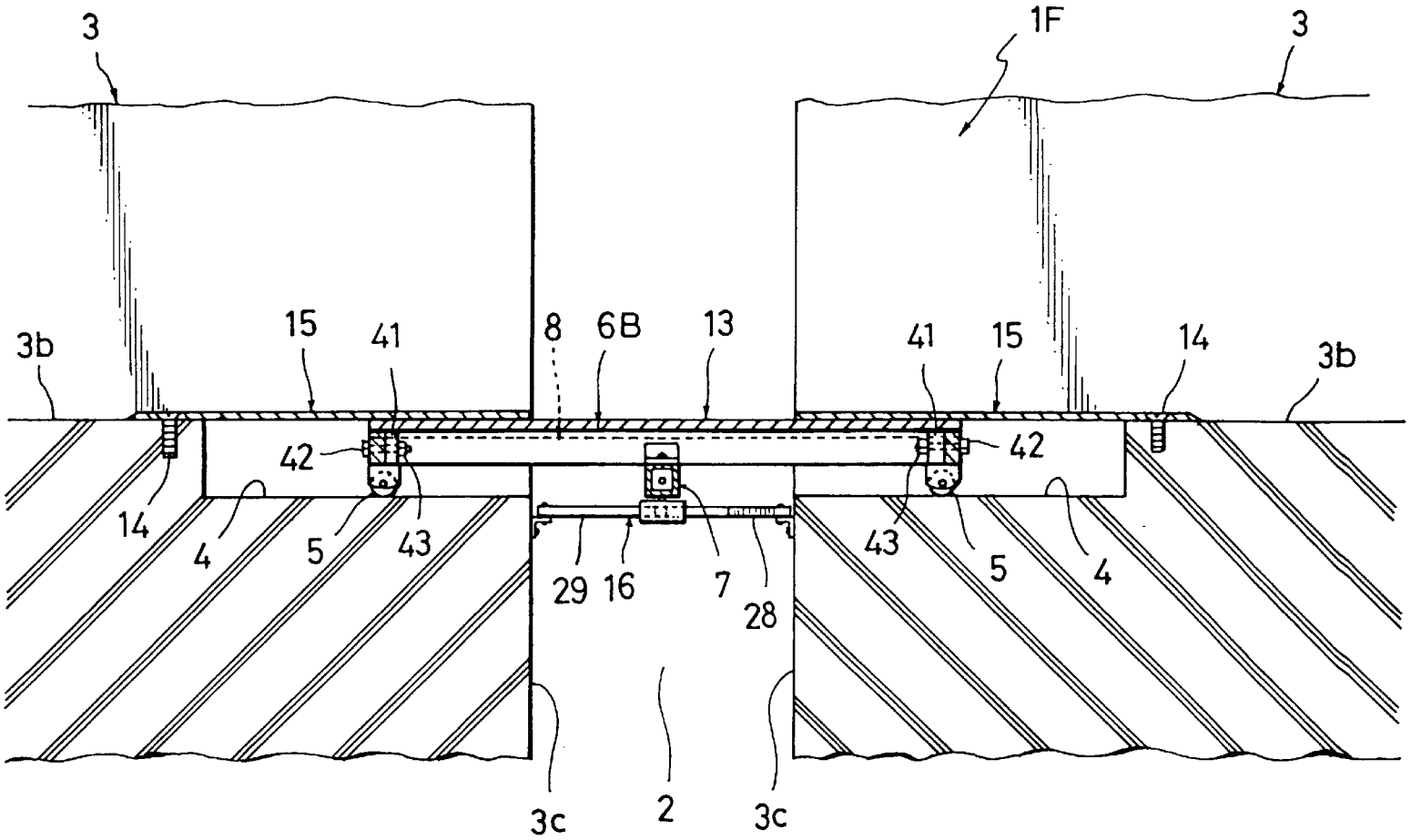
FIG. 34 is an expanded cross-sectional view taken along the line 34—34 of FIG. 33.
Figure 35:
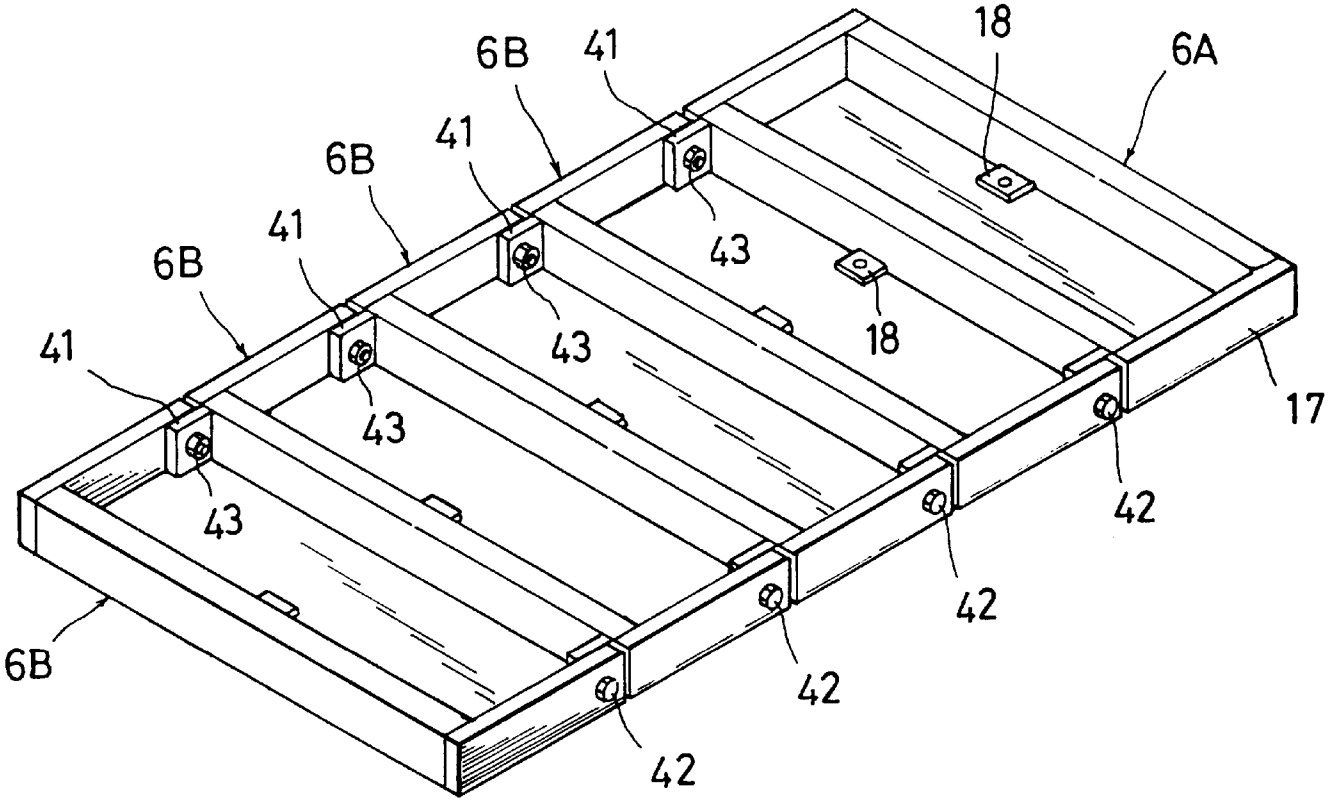
FIG. 35 is a perspective view showing connection of a support member according to the seventh embodiment of the present invention.
Figure 36:
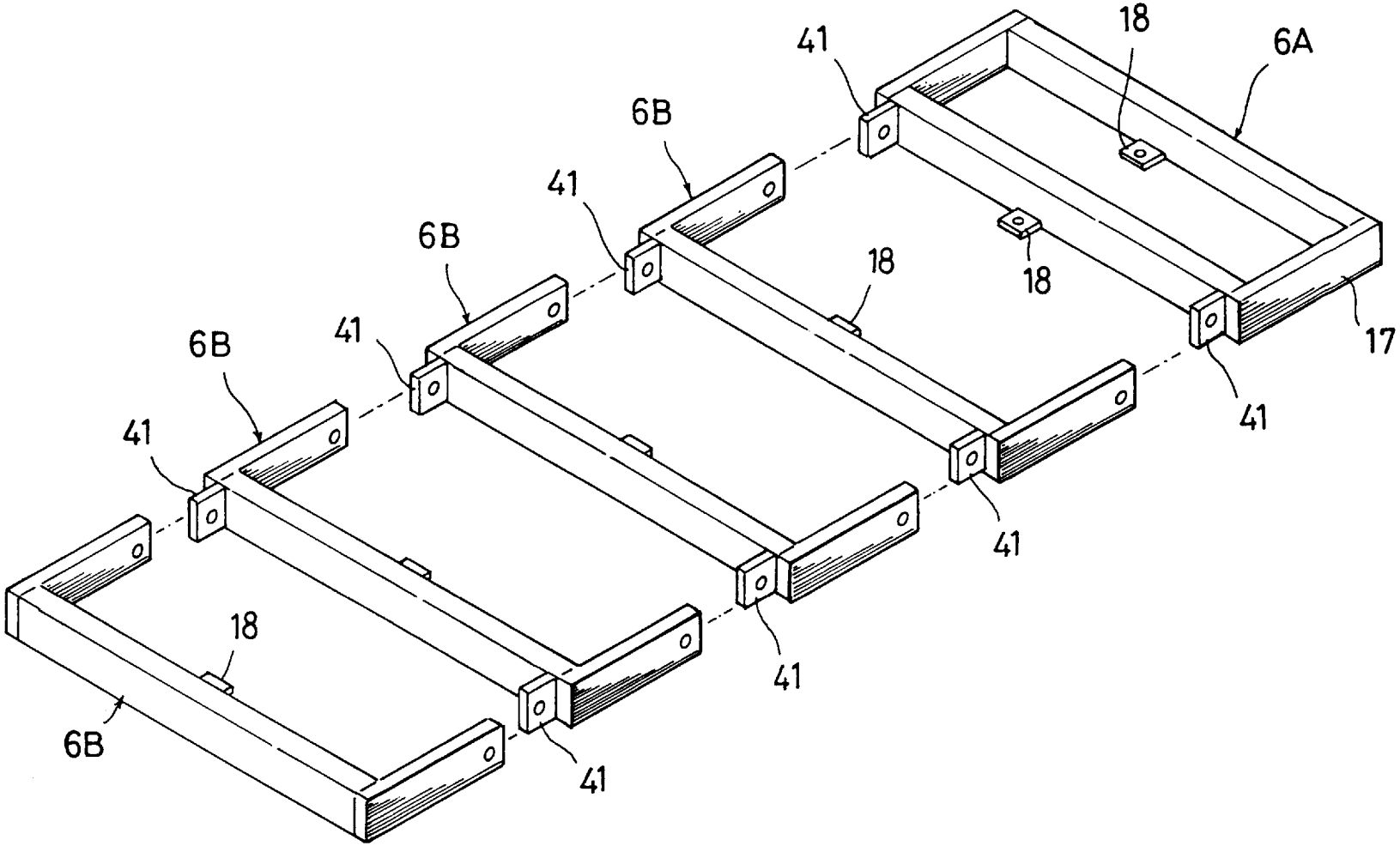
FIG. 36 is an exploded view showing separation of the support member of the seventh embodiment of the present invention.
Figure 37:
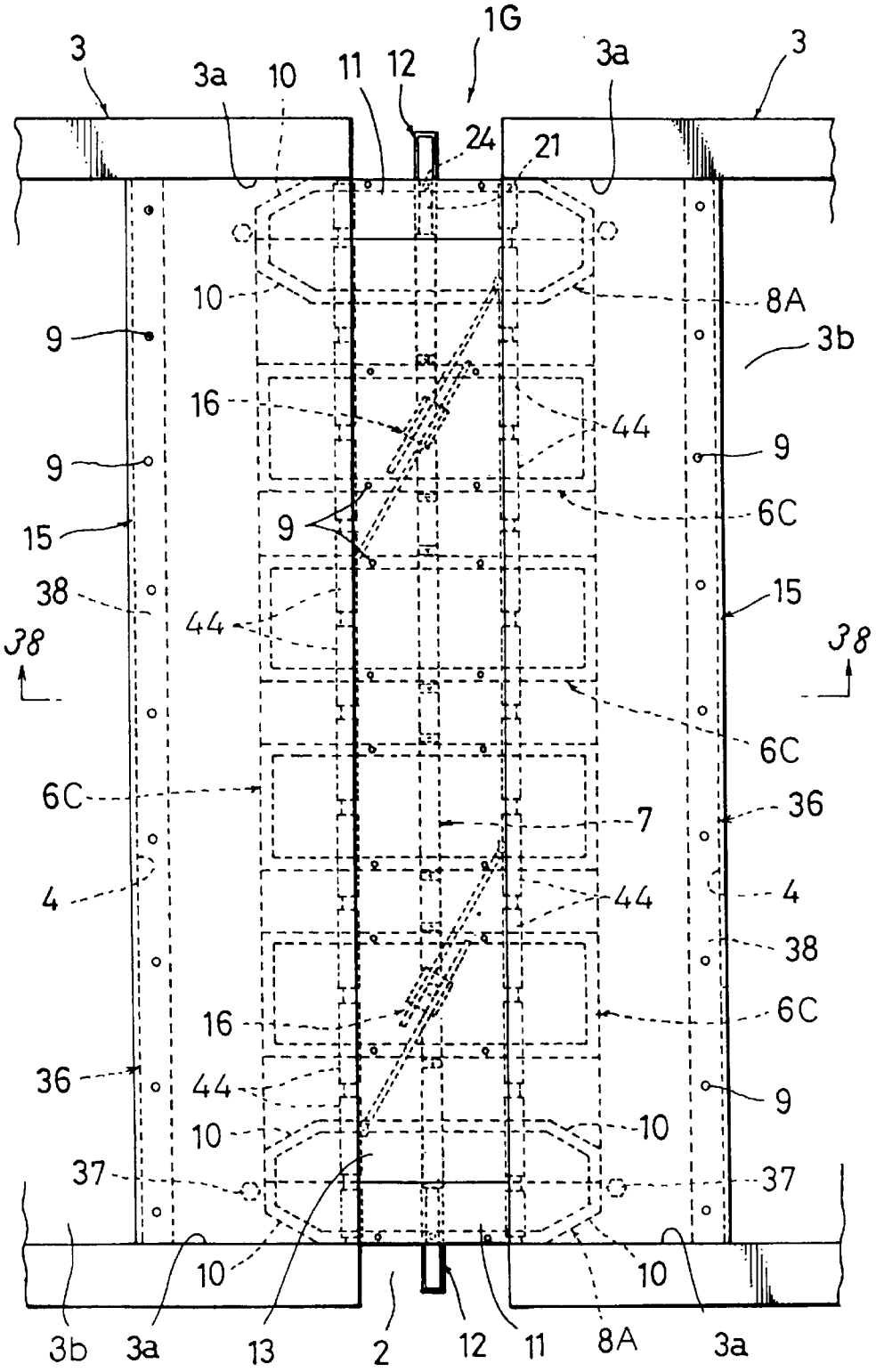
FIG. 37 is a plan view showing an eighth embodiment of the present invention.
Figure 38:
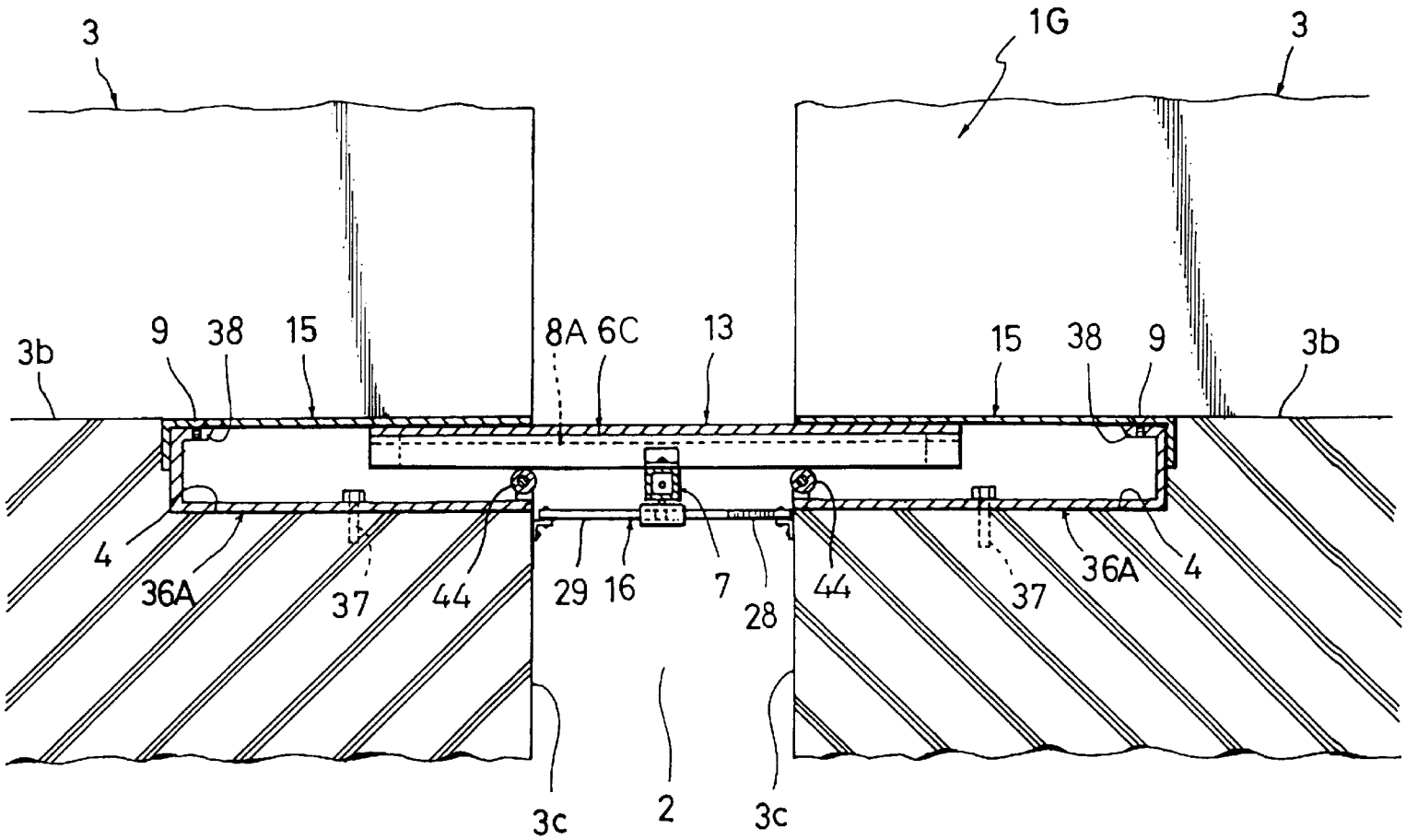
FIG. 38 is an expanded cross-sectional view taken along the line 38—38 of FIG. 37.
Figure 39:
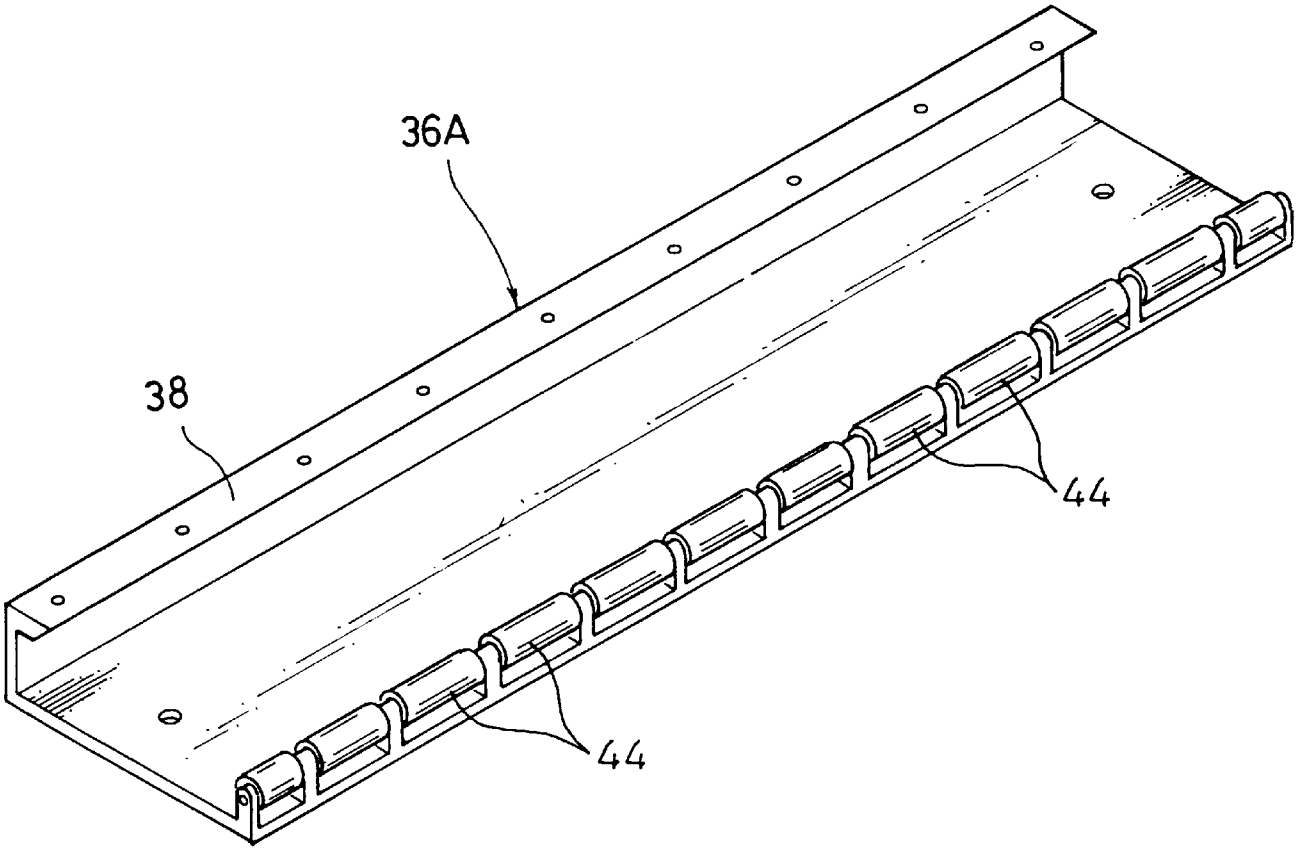
FIG. 39 is a perspective view of a substrate rail of the eighth embodiment of the present invention.
Figure 40:
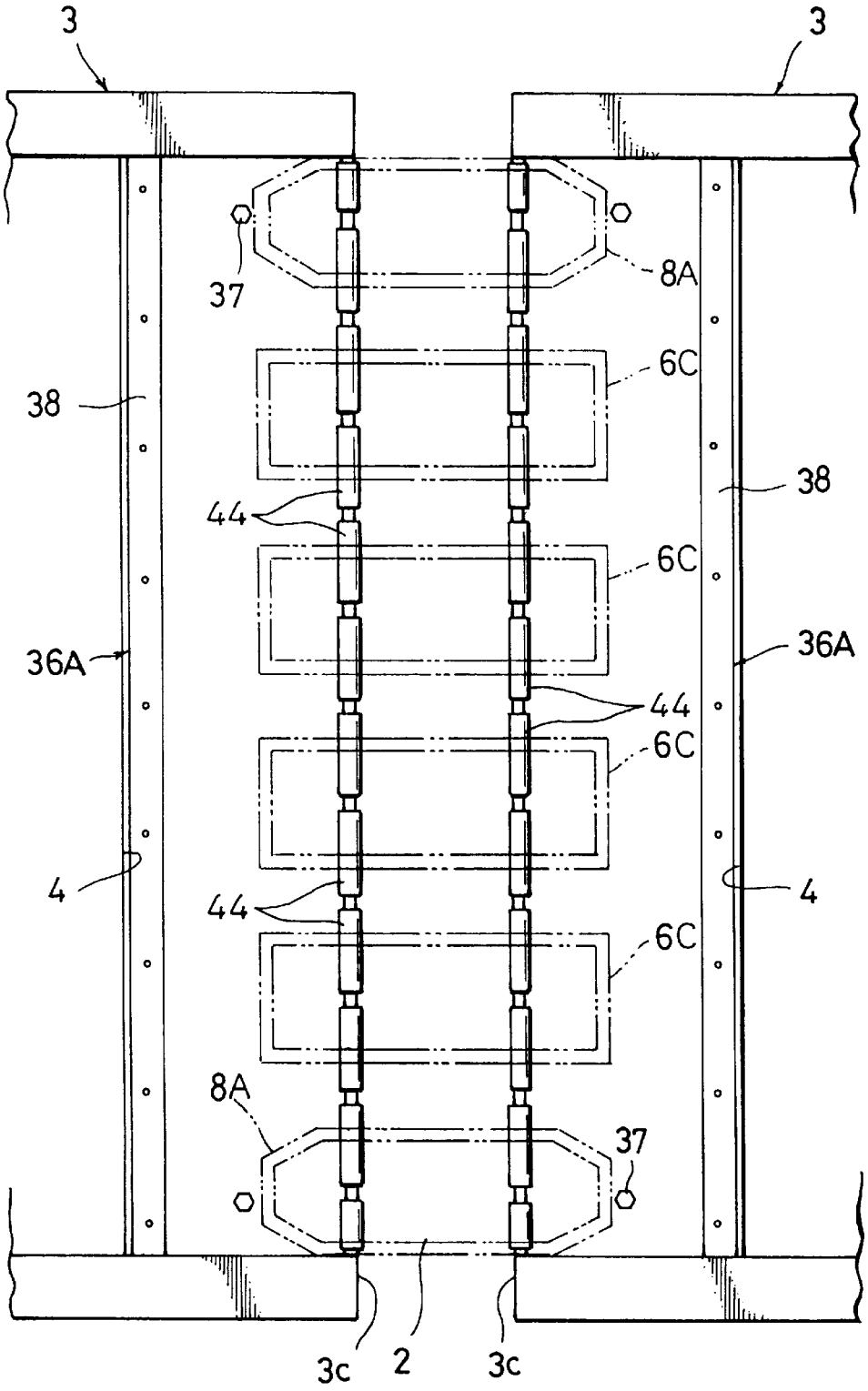
FIG. 40 is a view showing attachment of a substrate rail of the eighth embodiment of the present invention.

FIGS. 30 to 32 illustrate a sixth embodiment of the present invention which is distinguished from the third embodiment by the fact that both side surfaces of the joint plate 13A are sloping surfaces 39,39, and both side surfaces of the end joint plates 11A, 11A are sloping surfaces 40,40. Accordingly, a joint device 1E according to the sixth embodiment provides function similar to the third embodiment.

FIGS. 33 to 36 illustrate a seventh embodiment of the present invention which is distinguished from the first embodiment by the fact that support member 6 further comprises a support member 6A and support members 6B. The support member 6A is a frame having both side portions provided with attachments 41, 41. The support members 6B are formed in a channel shape with side portions having the attachments 41,41. The attachments 41 allow interconnection of the support member 6A and support members 6B by a bolt 42 and a nut 43. Accordingly, a joint device 1F according to the seventh embodiment provides function similar to the first embodiment.

FIGS. 37 to 40 illustrate an eighth embodiment of the present invention which is distinguished from the fourth embodiment by the fact that substrate rails 36A, 36A include a plurality of rollers 44 which are attached adjacent the joint 2, while the support members 6C and end support members 8A, 8A have no rollers on bottom faces thereof.

As set forth above, the advantages of the present invention are:

(1) A joint cover for covering a joint of a floor comprises a plurality of support members extended over the joint leaving openings at ends of the joint in the floor surface defined by right and left building portions. The support members are supported on rollers. End support members extend across the openings at the ends of the joint and have a width smaller than that of the openings. An end joint plate covers upper surfaces of each end support member and has tapered comers. A bias device biases the end support members such that an outer edge of the end joint plate contacts wall surfaces of right and left building portions. The bias devices are attached pivotably at a central portion adjacent an outer edge of each of the end joint plates so that the end joint plates move smoothly following swing or oscillation movement of right and left building portions.

(2) As discussed above, the end joint plate located at both ends of the joint can move following the swing or oscillation relative movement of right and left building portions.

Therefore, damage to the end plates is prevented and the end joint plate can cover a gap at ends of the joint plate. In addition, the appearance is improved greatly.

(3) As discussed above, the joint plate is attached to the plurality of support members so that size of the support member are not too big, and the weight is not too heavy. Therefore, the transportation and assembly operation can be done efficiently.

What is claimed is:

1. A joint cover for covering a joint gap in a floor between first and second building portions wherein the joint gap is bounded by side walls pairs, comprising:

support members disposed across said joint gap leaving an end opening between an end one of said support members and one of said side wall pairs;

said support members being supported on rollers;

an end support member having a width smaller than that of said end opening and disposed across the joint gap in said end opening;

an end joint plate forming an upper surface of said end support member, said end support member having a rectangular form except with four tapered off corners;

a biasing device for biasing the end support member toward said one of said side wall pairs such that said end joint plate abuts said one of said side wall pairs;

said biasing device being attached pivotably at a central portion adjacent an outer edge of said end joint plate; and a joint plate covering said support members and having an end portion projecting so as to cover a portion of said end joint plate.

2. A joint cover according to claim 1, wherein:

said support members have a configuration with four corners and are provided with said rollers proximate said four corners on bottom surface thereof; and said end support member has four corners and rollers proximate said four corners on a bottom surface thereof.

3. A joint cover according to claim 1, further comprising:

first and second substrate rails disposed on surfaces of said floor adjacent said joint gap; and said first and second substrate rails having said rollers mounted thereon for movably supporting said support members and rollers mounted thereon for movably supporting said end support member.

4. A joint cover according to claim 1, wherein:

said floor has recessed portions adjacent sides of said joint gap, said recessed portions each having a recess edge at said joint gap and a side wall distal of said recess edge;

said support members and said end support member are disposed bridging said joint gap and in said recessed portions; and said recessed portions having said side walls disposed apart a distance sufficient to permit movement of said support members and said end support member therebetween in a first direction perpendicular to said join gap.

5. A joint cover for covering a joint gap in a floor between first and second building portions wherein the joint gap is bounded by side wall pairs, comprising:

support members disposed across said joint gap leaving an end opening between an end one of said support members and one of said side wall pairs;

said support members having a bottom surface and four corners with rollers on said bottom surface thereof;

means for connecting said support members in series;

end support member having a width smaller than that of said end opening and disposed across the joint gap in said end opening;

said end support member having four corners and rollers proximate said four corners on a bottom surface thereof;

an end joint plate forming an upper surface of said end support member, said end support member having a rectangular form except with four tapered off corners;

a biasing device for biasing the end support member toward said one of said side wall pairs, said biasing device having a spring biasing a movement bar which has the end support member pivotally mounted thereon so as to bias the end support member toward said one of said side wall pairs; and a joint plate covering said support members and having an end portion projecting so as to cover a portion of said end joint plate.

6. A joint cover according to claim 5, further comprising:

first and second substrate rails disposed on surfaces of said floor adjacent said joint gap; and said first and second substrate rails having said rollers mounted thereon for movably supporting said support members and said rollers mounted thereon for movably supporting said end support member.

7. A joint cover according to claim 5, wherein:

said floor has recessed portions adjacent sides of said joint gap, said recessed portions each having a recess edge at said joint gap and a side wall distal of said recess edge;

said support members and said end support member are disposed bridging said joint gap and in said recessed portions; and said recessed portions having said side walls disposed apart a distance sufficient to permit movement of said support members and said end support member therebetween in a first direction perpendicular to said joint gap.

8. The joint cover according to claim 5, further comprising a center retaining device for maintaining said means for connecting at a substantially central portion of said joint gap.

9. A joint cover according to claim 5 wherein said means for connecting said support members in series includes a pipe connected at a substantially central portions of said bottom surface of said support members.

10. A joint cover for covering a joint gap in a floor between first and second building portions wherein the joint gap is bounded by side walls pairs, comprising:

a central plate slidably disposed across said joint gap to permit movement relative a portion of said floor disposed in at least one of said first and second building portions, said central plate being situated so as to define an end opening between a central plate end and one of said side wall pairs;

an end plate slidably disposed across the joint gap to permit movement relative a portion of said floor disposed in at least one of said first and second building portions, and substantially occupying said end opening; and a biasing device for biasing the end plate toward said one of said side wall pairs such that said end plate abuts said one of said side wall pairs.

11. A joint cover according to claim 10 wherein said biasing device is attached pivotably to said end plate to permit said end plate to pivot in response to ones of said one of said pairs of side walls moving in opposite directions along a first axis parallel said joint gap.

12. A joint cover according to claim 11 wherein said end plate presents an edge having tapered corners toward said one of said side wall pairs.

13. A joint cover according to claim 10 wherein said biasing device is attached pivotably to a substantially central portion of said end plate along an axis perpendicular to said joint gap to permit said end plate to pivot in response to ones said one of said pairs of side walls moving in opposite directions along an axis parallel said joint gap.

14. A joint cover according to claim 13 wherein said end plate presents an edge having tapered corners toward said one of said side wall pairs.

15. A joint cover according to claim 10 wherein said central plate overlaps a portion of said end plate.

16. A joint cover according to claim 10, wherein said central plate is slidably supported on rollers.

17. A joint cover according to claim 10, further comprising:

first and second substrate rails disposed on surfaces of said floor adjacent said joint gap; and said first and second substrate rails having rollers mounted thereon for slidably supporting said central plate and said end plate.

18. A joint cover according to claim 10, wherein:

said floor has recessed portions adjacent sides of said joint gap, said recessed portions each having a recess edge at said joint gap and a side wall distal of said recess edge;

said central plate and said end plate are disposed bridging said joint gap and in said recessed portions; and said recessed portions having said side walls disposed apart a distance sufficient to permit movement of said central plate and said end plate therebetween in a first direction perpendicular to said joint gap.

19. A joint cover according to claim 10 further comprising:

said central plate being slidably disposed to permit movement relative portions of said floor disposed both of said building portions;

said end plate being slidably disposed to permit movement relative portions of said floor disposed in both of said first and second building portions; and a centralizing mechanism maintaining said central plate and said end plate substantially in a center of said joint gap.

20. A joint cover according to claim 19 wherein said biasing device is attached pivotably to a substantially central portion of said end plate along an axis perpendicular to said joint gap to permit said end plate to pivot in response to ones said one of said pairs of side walls moving in opposite directions along an axis parallel said joint gap.

21. A joint cover according to claim 20 wherein said biasing device is connected to and maintained substantially in a center of said joint gap by said centralizing mechanism.

22. A joint cover according to claim 21 wherein said centralizing mechanism includes at least first and second racks connected to said floor at opposing sides of said joint gap and interconnected by a pinion gear engaging said first and second racks, and said pinion gear is connected to said central plate and said end plate.

23. A joint cover according to claim 19 wherein said biasing device is connected to and maintained substantially in a center of said joint gap by said centralizing mechanism.

24. A joint cover according to claim 23 wherein said centralizing mechanism includes at least first and second racks connected to said floor at opposing sides of said joint gap and interconnected by a pinion gear engaging said first and second racks, and said pinion gear being connected to said central plate and said end plate.

25. A joint cover according to claim 19 wherein said centralizing mechanism includes at least first and second racks connected to said floor at opposing sides of said joint gap and interconnected by a pinion gear engaging said first and second racks, and said pinion gear being connected to said central plate and said end plate.

* * * * *